US008827328B2

(12) United States Patent
Akizuki et al.

(10) Patent No.: US 8,827,328 B2
(45) Date of Patent: Sep. 9, 2014

(54) VEHICLE DOOR LOCK DEVICE

(75) Inventors: Ryujiro Akizuki, Novi, MI (US); Takashi Nishio, Aichi-ken (JP); Nobuko Watanabe, Anjo (JP); Yasuhiko Sono, Hekinan (JP); Kazunori Kojima, Aichi (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/696,815

(22) PCT Filed: Mar. 10, 2011

(86) PCT No.: PCT/JP2011/055634

§ 371 (c)(1),
(2), (4) Date: Nov. 8, 2012

(87) PCT Pub. No.: WO2011/148697

PCT Pub. Date: Dec. 1, 2011

(65) Prior Publication Data

US 2013/0056996 A1 Mar. 7, 2013

(30) Foreign Application Priority Data

May 26, 2010 (JP) ..... 2010-120339

(51) Int. Cl.

| | |
|---|---|
| ***E05C 3/06*** | (2006.01) |
| ***E05B 85/02*** | (2014.01) |
| ***E05B 81/06*** | (2014.01) |
| *E05C 3/00* | (2006.01) |
| *E05B 79/04* | (2014.01) |

(52) U.S. Cl.

CPC ..... *E05B 81/06* (2013.01); *E05B 85/02* (2013.01); *E05B 79/04* (2013.01)

USPC ..... 292/201; 292/196; 292/216

(58) Field of Classification Search

USPC ..... 292/196, 201, 216

See application file for complete search history.

(56) References Cited

U.S. PATENT DOCUMENTS 5,338,076 A * 8/1994 Tanaka ..... 292/336.3
5,564,308 A * 10/1996 Hoshikawa et al. ..... 74/89.14

(Continued)

FOREIGN PATENT DOCUMENTS

DE 19905063 A1 2/1999
EP 0952288 A1 10/1999

(Continued)

OTHER PUBLICATIONS

International Search Report (PCT/ISA/210) issued on May 31, 2011, by the Japanese Patent Office as the International Searching Authority for International Application No. PCT/JP2011/055634.

(Continued)

*Primary Examiner* — Carlos Lugo

(74) *Attorney, Agent, or Firm* — Buchanan Ingersoll & Rooney PC

(57) ABSTRACT

A vehicle door lock device includes a housing including: an outer housing body including a covering portion covering an outer side of an electric motor and an outer side of a worm, an outer shaft-supporting portion supporting an active lever, and an outer shaft-supporting portion supporting a worm wheel; and an inner housing body including an inner shaft-supporting portion supporting an active lever, and an inner shaft-supporting portion supporting the worm wheel. An outer surface of the covering portion of the outer housing body and an outer surface of the outer shaft-supporting portion, which is provided in the outer housing body, for supporting the active lever, are formed in the same flat surface, and an outer surface of the outer shaft-supporting portion, which is provided in the outer housing body, for supporting the worm wheel, is formed in a dented surface dented inwardly with respect to the flat surface.

14 Claims, 14 Drawing Sheets

(56) References Cited

U.S. PATENT DOCUMENTS

| | | | | |
|---|---|---|---|---|
| 5,649,726 | A | 7/1997 | Rogers, Jr. et al. | |
| 5,746,076 | A * | 5/1998 | Inoue | 70/277 |
| 5,860,683 | A * | 1/1999 | Sekino et al. | 292/216 |
| 6,012,747 | A * | 1/2000 | Takamura et al. | 292/216 |
| 6,131,967 | A * | 10/2000 | Kondo et al. | 292/201 |
| 6,145,354 | A * | 11/2000 | Kondo et al. | 70/279.1 |
| 6,913,298 | B2 * | 7/2005 | Inoue | 292/216 |
| 6,945,574 | B2 | 9/2005 | Hayakawa et al. | |
| 7,021,681 | B2 * | 4/2006 | Hayakawa et al. | 292/216 |
| 7,048,313 | B2 * | 5/2006 | Fukunaga et al. | 292/216 |
| 7,055,872 | B2 * | 6/2006 | Hayakawa et al. | 292/216 |
| 7,441,815 | B2 * | 10/2008 | Umino | 292/216 |
| 7,568,741 | B2 * | 8/2009 | Odahara | 292/216 |
| 7,631,907 | B2 * | 12/2009 | Sato | 292/216 |
| 8,029,028 | B2 * | 10/2011 | Akizuki et al. | 292/201 |
| 8,146,965 | B2 * | 4/2012 | Akizuki et al. | 292/201 |
| 8,267,444 | B2 * | 9/2012 | Akizuki et al. | 292/201 |
| 8,276,949 | B2 | 10/2012 | Akizuki et al. | |
| 8,333,414 | B2 * | 12/2012 | Takayanagi et al. | 292/201 |
| 2004/0036298 | A1 * | 2/2004 | Hayakawa et al. | 292/216 |
| 2007/0075552 | A1 * | 4/2007 | Hayakawa et al. | 292/216 |
| 2010/0171321 | A1 * | 7/2010 | Akizuki et al. | 292/200 |
| 2010/0327609 | A1 * | 12/2010 | Akizuki et al. | 292/85 |
| 2011/0162419 | A1 | 7/2011 | Akizuki et al. | |

FOREIGN PATENT DOCUMENTS

| | | | |
|---|---|---|---|
| JP | 2004-190444 | A | 7/2004 |
| JP | 3736267 | B2 | 1/2006 |
| JP | 2010-84320 | A | 4/2010 |

OTHER PUBLICATIONS

Written Opinion (PCT/ISA/237) issued on May 31, 2011, by the Japanese Patent Office as the International Searching Authority for International Application No. PCT/JP2011/055634.

European Supplementary Search Report dated Jun. 12, 2013 issued in the corresponding European Patent Application No. 11786397.7-1603/2578779.

* cited by examiner

VEHICLE DOOR LOCK DEVICE

TECHNICAL FIELD

The present invention relates to a vehicle door lock device, and more particularly, to a vehicle door lock device including: a latch mechanism, which is capable of maintaining a door of a vehicle in a closed state with respect to a body, and is assembled to the door together with a housing; an open lever, which is rotatably assembled to the housing, and is driven along with an operation of a door handle provided on an inner side or an outer side of the door; an open link, which is interposed between the open lever and a lift lever provided to the latch mechanism, and is switchable between an unlocked position at which an actuation of the open lever in a door opening direction along with a door opening operation of the door handle is transferred to the lift lever, and a locked position at which the actuation is not transferred to the lift lever; and an electric actuator for switching the open link between the unlocked position and the locked position.

BACKGROUND ART

The vehicle door lock device of this type is disclosed in, for example, Patent Document 1 or 2 below. In the vehicle door lock device described in Patent Document 1 or 2 below, the electric actuator includes: an active lever, which is rotatably assembled to the housing, and is capable of switching the open link between the unlocked position and the locked position; a gear unit arranged on an outer side of the active lever; an electric motor for rotationally driving the gear unit; and a converting mechanism provided between the active lever and the gear unit, for converting motion of the gear unit into motion of the active lever, and the gear unit includes: a worm, which is rotationally driven by the electric motor; and a worm wheel, which is rotatably assembled to the housing to mesh with the worm, and is linked to the active lever through the intermediation of the converting mechanism.

PRIOR ART DOCUMENT

Patent Document

[Patent Document 1]: JP 3736267 B
[Patent Document 2]: JP 2004-190444 A

SUMMARY OF THE INVENTION

Technical Problems

By the way, in the vehicle door lock device described in the above-mentioned Patent Document 1, the housing includes an outer housing body and an inner housing body, and an outer surface of the outer housing body, apart from a portion of the outer surface accommodating a part of the electric motor (protruded surface situated at an oblique upper portion of the outer surface in side view and protruded outwardly in plan view), is formed into a flat surface (general surface). Accordingly, when the device is assembled to the door of the vehicle, a worker can hold a center portion of the outer housing body and a center portion of the inner housing body in his/her hand.

However, in the vehicle door lock device described in the above-mentioned Patent Document 1, when a worker holds the device (which is normally carried from the inner side of the door into an inside of the door, and then is assembled to the door) in the hand, a thumb of the hand is put on an inner surface of the inner housing body of the housing, and an index finger, a middle finger, etc. of the hand are put on the flat surface (general surface) in the outer surface of the outer housing body of the housing. As a result, slip may occur on the flat surface (general surface) in the outer surface of the outer housing body on which the index finger, the middle finger, etc. of the hand are put. Accordingly, a rib or a textured shape (concavo-convex shape) for preventing slip is sometimes additionally formed in the flat surface (general surface) in the outer surface of the outer housing body on which the index finger, the middle finger, etc. of the hand are put.

Further, in the vehicle door lock device described in the above-mentioned Patent Document 1 or 2, a direction of a rotation axis of the open link is the same as a direction of a rotation axis of the active lever and the worm wheel that are provided to be rotated about the rotation axis different from the rotation axis of the open link, and hence it is difficult to arrange the active lever and the worm wheel close to the latch mechanism. Accordingly, the housing tends to be increased in size in an extending direction (for example, up-and-down direction) of a surface on which the electric actuator is disposed.

Solution to Problems

The present invention has been made to solve the problems described above. A vehicle door lock device according to the present invention includes: a latch mechanism, which is capable of maintaining a door of a vehicle in a closed state with respect to a body, and is adapted to be assembled to the door together with a housing; an open lever, which is rotatably assembled to the housing, and is adapted to be driven along with an operation of a door handle provided on an inner side or an outer side of the door; an open link, which is interposed between the open lever and a lift lever provided to the latch mechanism, and is adapted to be switchable between an unlocked position at which an actuation of the open lever in a door opening direction along with a door opening operation of the door handle is transferred to the lift lever, and a locked position at which the actuation is not transferred to the lift lever; and an electric actuator for switching the open link between the unlocked position and the locked position, in which the electric actuator includes: an active lever, which is rotatably assembled to the housing, and is capable of switching the open link between the unlocked position and the locked position; a gear unit arranged on an outer side of the active lever; an electric motor for rotationally driving the gear unit; and a converting mechanism provided between the active lever and the gear unit, for converting motion of the gear unit into motion of the active lever, in which the gear unit includes: a worm, which is rotationally driven by the electric motor; and a worm wheel, which is rotatably assembled to the housing to mesh with the worm, and is linked to the active lever through the intermediation of the converting mechanism, in which the open link is arranged so as to be pivotable with respect to the housing about a rotation axis whose direction is different from a direction of a rotation axis of the active lever and the worm wheel, in which the worm wheel is arranged between the latch mechanism and the electric motor, in which the housing includes: an outer housing body including a covering portion covering an outer side of the electric motor and an outer side of the worm, an outer shaft-supporting portion supporting the active lever, and an outer shaft-supporting portion supporting the worm wheel; and an inner housing body including an inner shaft-supporting portion supporting the active lever, and an inner shaft-supporting portion supporting the worm wheel, in which an outer surface of the covering portion of the outer housing body and an outer surface of the outer shaft-supporting portion, which is provided in the outer housing body, for supporting the active lever, are formed in the same flat surface, and in which an outer surface of the outer shaft-supporting portion, which is provided in the outer housing body, for supporting the worm wheel, is formed in a dented surface dented inwardly with respect to the flat surface.

In this case, the vehicle door lock device may further include a locking control lever provided within the housing between the latch mechanism and the electric motor so as to extend in an up-and-down direction, the locking control lever having an upper end portion rotatably supported onto the housing and linked to a key cylinder provided on the outer side of the door, and having a lower end portion linked to the active lever, and an outer surface of an outer shaft-supporting portion, which is provided in the outer housing body, for supporting the locking control lever, may be level and continuous with the dented surface. In these cases, it is preferred that the dented surface be formed into a shape elongated in the up-and-down direction. Further, the latch mechanism and the electric motor may be arranged at the same level with respect to the housing. The same level means that, under a state in which the vehicle door lock device is assembled to the door, the electric motor is arranged so as to overlap a plane of the latch mechanism projected along a fore-and-aft direction of the door.

When carrying out the present invention described above, the open lever may include: an inside open lever, which is rotatably assembled to the housing, and is adapted to be rotationally driven from an initial position to an actuation position along with a door opening operation of an inside door handle provided on the inner side of the door; and an outside open lever, which is rotatably assembled to the housing, and is adapted to be rotationally driven from an initial position to an actuation position along with a door opening operation of an outside door handle provided on the outer side of the door, the open link may be assembled to a coupling portion so as to be capable of tilting by a predetermined degree, may include a pushing portion engageable with an engagement portion of the lift lever provided to the latch mechanism, and may be pushed from an initial position toward the lift lever when the inside open lever is rotationally driven from the initial position to the actuation position or when the outside open lever is rotationally driven from the initial position to the actuation position, the coupling portion being displaced along with rotation of the outside open lever, the active lever may be rotatably assembled to the housing, and may be switched from an unlocked position to a locked position through a locking operation of a lock/unlock operation member to bring the open link into a locked state, and switched from the locked position to the unlocked position through an unlocking operation of the lock/unlock operation member to bring the open link into an unlocked state, and the vehicle door lock device may further include: a spring interposed between the outside open lever and the open link, for biasing the open link so that the open link is brought into the unlocked state, and for retaining the open link movable relative to the lift lever so as to permit the open link to return to the initial position; an unlocked state maintaining guide for maintaining the open link in the unlocked state when the active lever is at the unlocked position and the outside open lever is rotated between the initial position and the actuation position; a locked state maintaining guide for maintaining the open link in the locked state when the active lever is at the locked position and the outside open lever is rotated between the initial position and the actuation position; and a push arm portion provided to the active lever, the push arm portion being engaged with the open link in the unlocked state so as to tilt the open link through switching the active lever from the unlocked position to the locked position when the active lever is at the unlocked position, and being disengageable from the open link in the locked state so as to permit the open link to shift to the unlocked state.

Advantageous Effects of Invention

According to the vehicle door lock device of the present invention, the open link is arranged so as to be pivotable with respect to the housing about the rotation axis whose direction is different from the direction of the rotation axis of the active lever and the worm wheel. Thus, the active lever and the worm wheel can be arranged close to the latch mechanism, and hence increase in size of the housing can be prevented. In addition, it is not necessary that the open link be arranged so as to overlap the worm wheel and the active lever in the direction of the rotation axis of the active lever. Thus, for example, in a portion of the outer housing body of the housing in which the worm wheel is arranged (that is, portion in which the open link is not arranged), it is possible to form the dented surface dented inwardly with respect to the flat surface of the outer housing body (that is, general surface in which the outer surface of the covering portion covering the outer side of the electric motor and the outer side of the worm, and the outer surface of the outer shaft-supporting portion supporting the active lever are formed at the same level).

Further, the dented surface dented inwardly with respect to the above-mentioned flat surface (general surface) is formed in the portion of the outer housing body of the housing in which the worm wheel is arranged. With this configuration, a worker can hold the portion of the housing, in which the worm wheel is arranged, in his/her hand in the following manner. Specifically, a thumb of the hand is put on an inner surface of the inner housing body, and an index finger, a middle finger, etc. of the hand are put on the dented surface formed in the outer surface of the outer housing body. At this time, a step formed between the flat surface (general surface) and the dented surface in the outer housing body of the housing can be used to prevent slip of the index finger, the middle finger, etc. of the hand, and hence a rib or a textured shape (concavo-convex shape) for preventing slip does not need to be additionally formed in the outer housing body of the housing.

Accordingly, when the device is assembled to the door of the vehicle while the device is held by a worker in the hand, the portion of the device to be held in the hand is less likely to cause slip, and hence is easily held in the hand. Therefore, it is possible to achieve satisfactory workability when the device is assembled to the door. Further, in the device, the rib or the textured shape (concavo-convex shape) for preventing slip does not need to be additionally formed in the outer housing body of the housing, and hence it is also possible to reduce cost.

Further, according to the vehicle door lock device of the present invention, the outer surface of the outer shaft-supporting portion, which is provided in the outer housing body, for supporting the worm wheel, is formed in the dented surface dented inwardly with respect to the flat surface. Thus, when compared to a case where the outer surface of the outer shaft-supporting portion, which is provided in the outer housing body, for supporting the worm wheel, is formed at the same level as that of the flat surface, it is possible to reduce an axial length of the outer shaft-supporting portion provided in the outer housing body, for rotatably supporting the worm wheel, and hence it is possible to increase manufacturing accuracy of the outer shaft-supporting portion. Accordingly, it is possible to increase accuracy of assembly of the worm wheel to the housing, and to increase meshing accuracy between the worm and the worm wheel.

Further, when carrying out the present invention described above, in the case where the locking control lever is provided within the housing between the latch mechanism and the electric motor so as to extend in the up-and-down direction, and the locking control lever has the upper end portion rotatably supported onto the housing and linked to the key cylinder provided on the outer side of the door, and has the lower end portion linked to the active lever, and in the case where the outer surface of the outer shaft-supporting portion, which is provided in the outer housing body, for supporting the locking control lever, is level and continuous with the dented surface, a length of the dented surface in the up-and-down direction enables all of the index finger, the middle finger, a ring finger, a little finger, etc. of the hand to be easily put onto the dented surface, and hence the device can be appropriately held in the five fingers of the hand.

Further, when carrying out the present invention described above, in the case where the latch mechanism and the electric motor are arranged at the same level with respect to the housing, and the worm wheel is arranged between the latch mechanism and the electric motor, the latch mechanism and the electric motor (both are parts having large weight) are dispersed and arranged in a balanced manner with respect to the housing. Accordingly, the device has a good weight balance with respect to a portion to be held in the hand (center portion of the housing in which the worm wheel is arranged), and hence the device can be held in a stable state.

MODE FOR CARRYING OUT THE INVENTION

Figure 1:
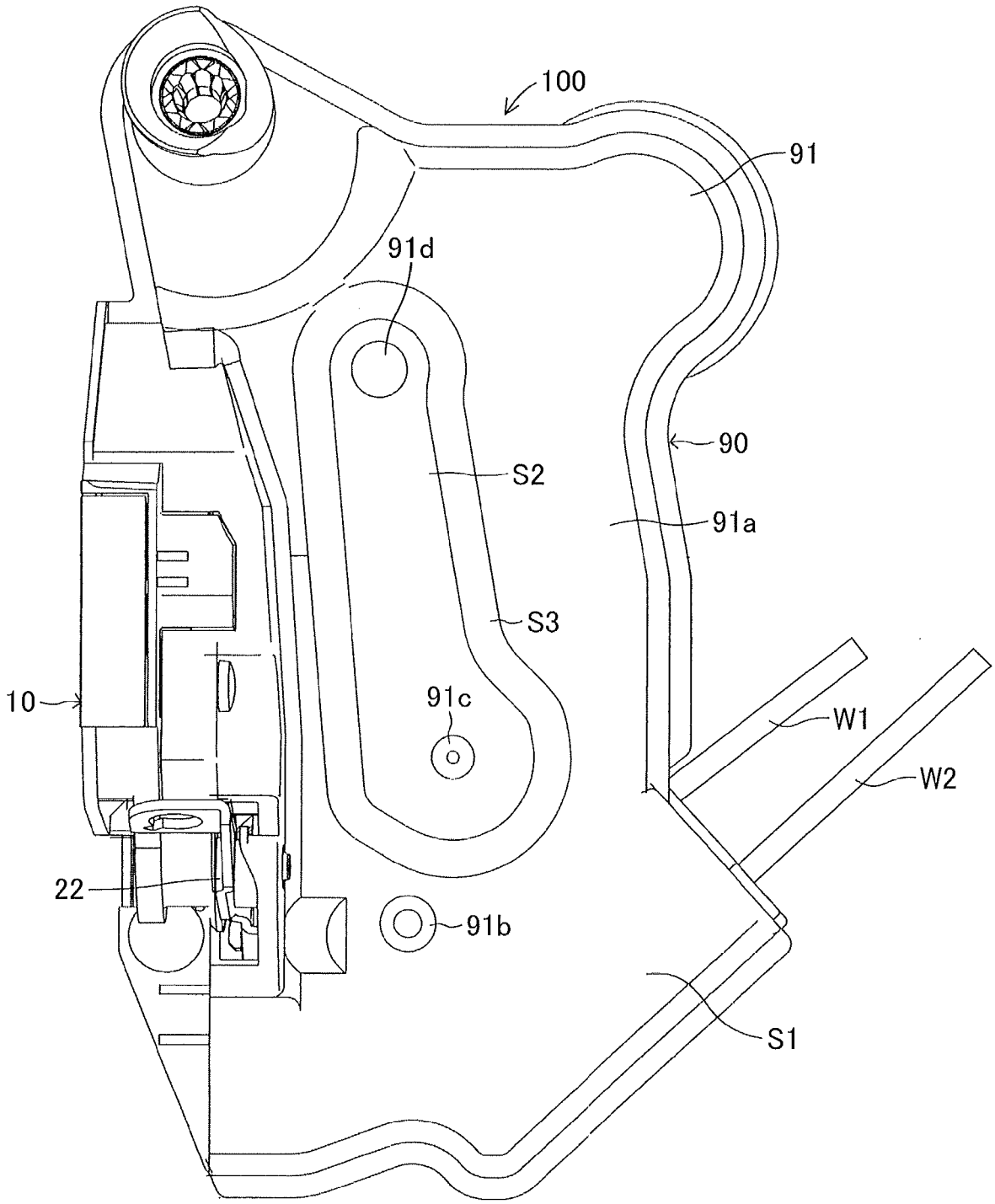
FIG. 1 is a side view seen from an outer side of a vehicle, for illustrating a vehicle door lock device according to an embodiment of the present invention.

In the following, an embodiment of the present invention is described with reference to the drawings. FIGS. 1 to 17 illustrate a vehicle door lock device 100 according to the present invention. The vehicle door lock device 100 is mounted to a door 201 which is installed on a front right side of a vehicle (see FIG. 17). The vehicle door lock device 100 includes a latch mechanism 10, an inside open lever 21, and an outside open lever 22, and further includes an open link 23, a spring 24, and an active lever 25. The vehicle door lock device 100 further includes an unlocked state maintaining guide 92*a* provided to an inner housing body 92 of a housing 90, and a locked state maintaining guide 25*a* and a push arm portion 25*c* provided to the active lever 25.

Figure 2:
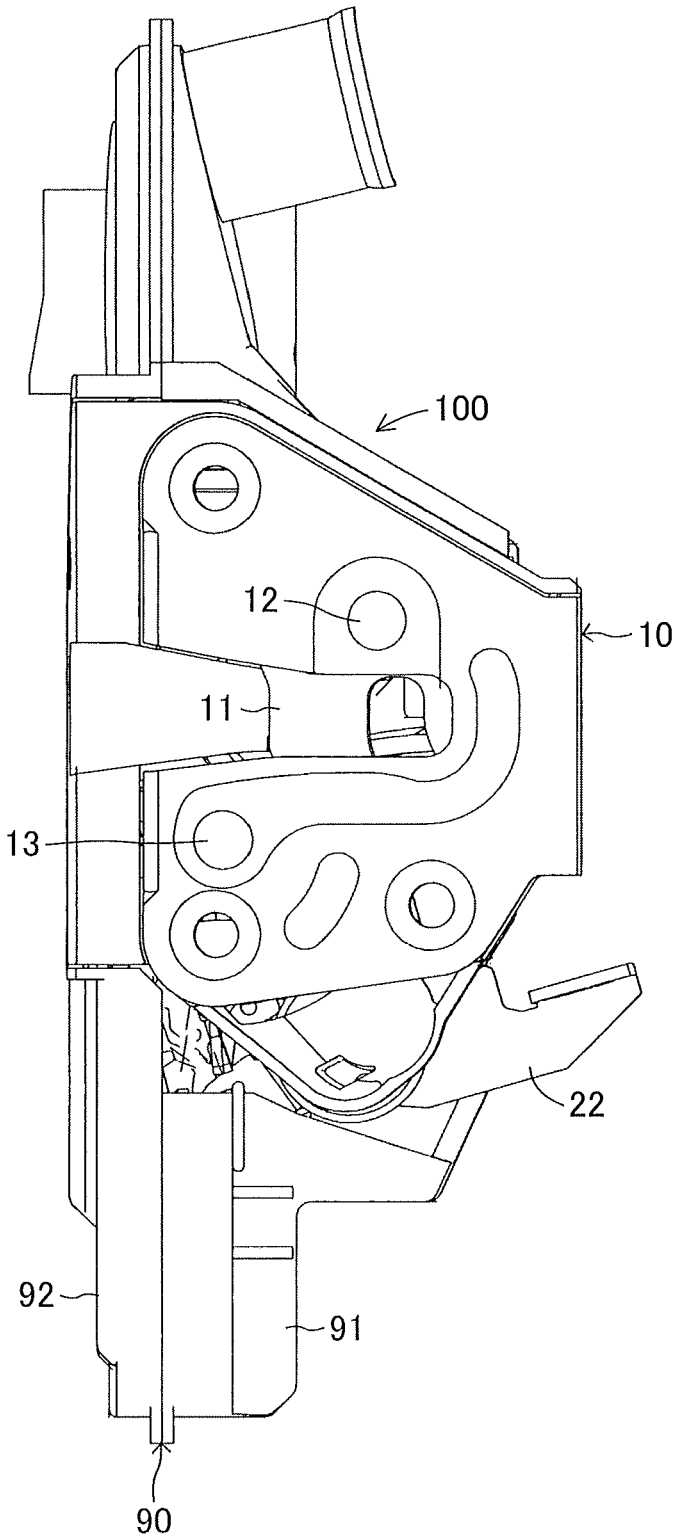
FIG. 2 is a left side view of the vehicle door lock device illustrated in FIG. 1.
Figure 3:
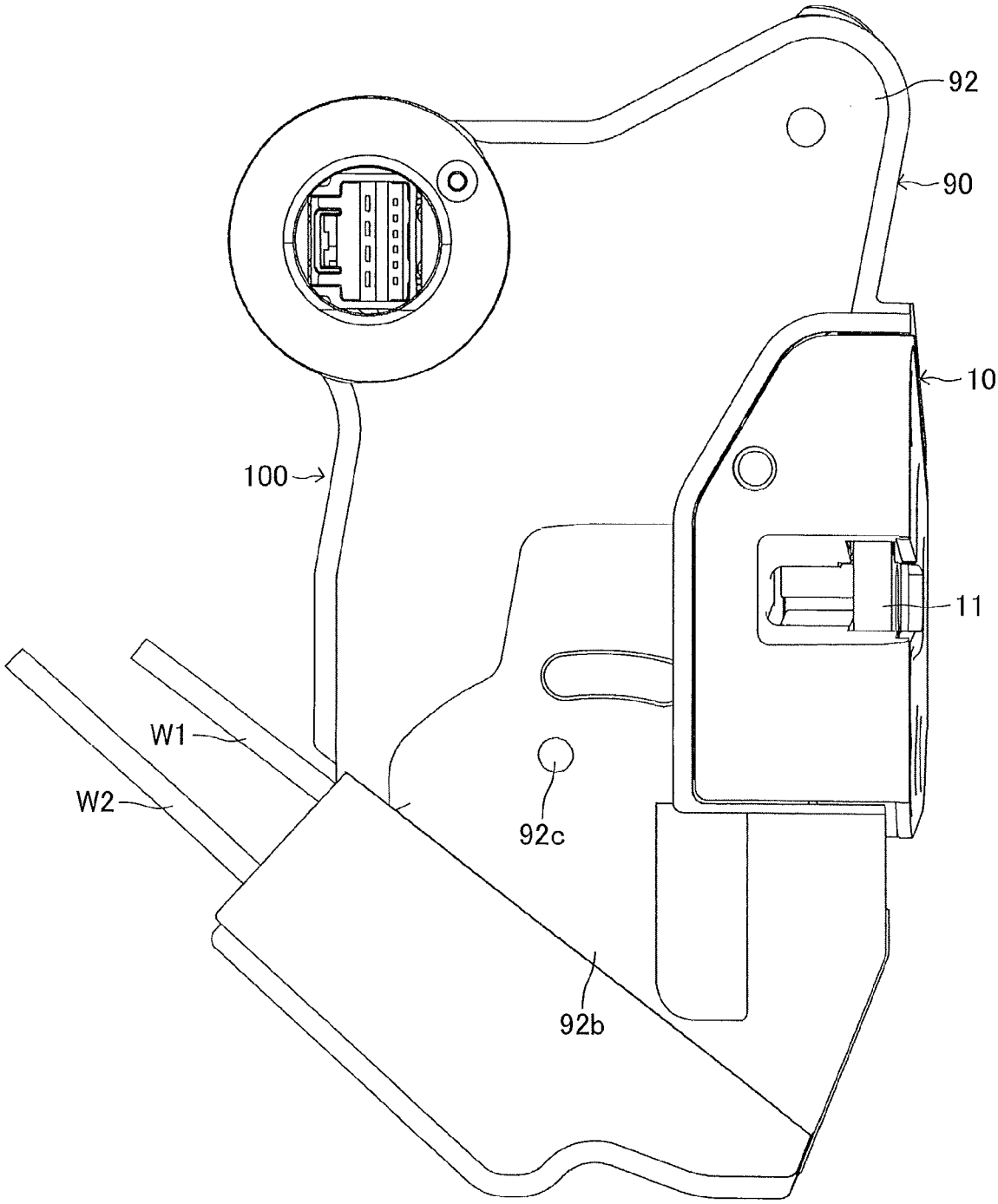
FIG. 3 is a side view seen from an inner side of the vehicle, for illustrating the vehicle door lock device illustrated in FIG. 1.

As is well known, the latch mechanism 10 is configured to maintain the door 201 in a closed state with respect to a body 202 (vehicle body illustrated in FIG. 17), and is assembled to the housing 90 including an outer housing body 91 and the inner housing body 92, that is, assembled to the door 201 together with the housing 90. The latch mechanism 10 includes: a latch 11 (see FIGS. 2 and 3) rotatably assembled to a support shaft 12 and engageable with and disengageable from a striker 203 which is fixed to the vehicle body 202; a pawl 13 (whose rotation shaft portion is illustrated in FIGS. 2, 6, etc.) which is engageable with and disengageable from the latch 11 and is capable of maintaining and releasing the engagement of the latch 11 with the striker 203; and a lift lever 14 (see FIGS. 4 to 10) provided integrally with the pawl 13.

Figure 6:
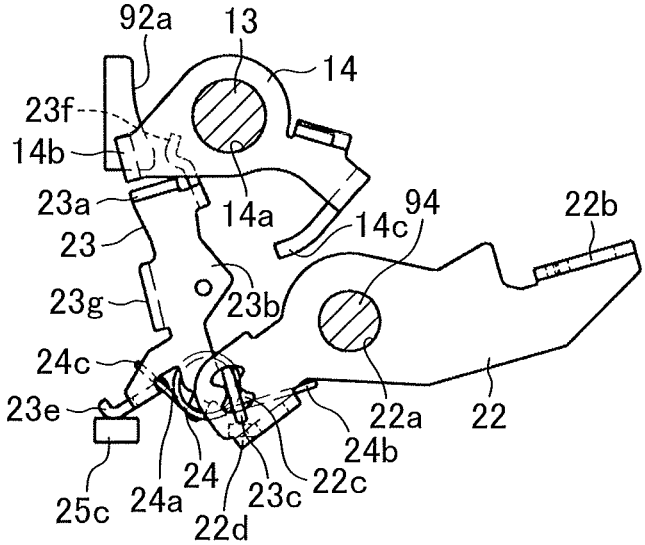
FIG. 6 is a view for illustrating a relationship in a vehicle width direction of an outside open lever, a spring, an open link, an active lever, and the lift lever, which are illustrated in FIG. 5, with respect to an unlocked state maintaining guide provided to the inner housing body of the housing.

As illustrated in FIG. 6, the lift lever 14 is assembled integrally to the rotation shaft portion of the pawl 13 through a fitting hole 14*a* thereof, and rotates integrally with the pawl 13. The lift lever 14 includes an engagement arm portion 14*b* engageable with and disengageable from a push head portion 23*a* of the open link 23, and further includes a push leg portion 14*c* engageable with and disengageable from a receiving body portion 23*b* of the open link 23. A main portion of the lift lever 14 (portion of the lift lever 14 which is fitted to the rotation shaft portion of the pawl 13) rotates in a plane substantially parallel to the drawing sheet of FIG. 6.

In the above-mentioned latch mechanism 10, when the latch 11 engages with the striker 203 and their engagement is maintained, the door 201 is maintained in a closed state (latched state). Further, in the latch mechanism 10, when the latch 11 disengages and separates from the striker 203, the door 201 shifts from the closed state to an opened state (unlatched state).

Figure 4:
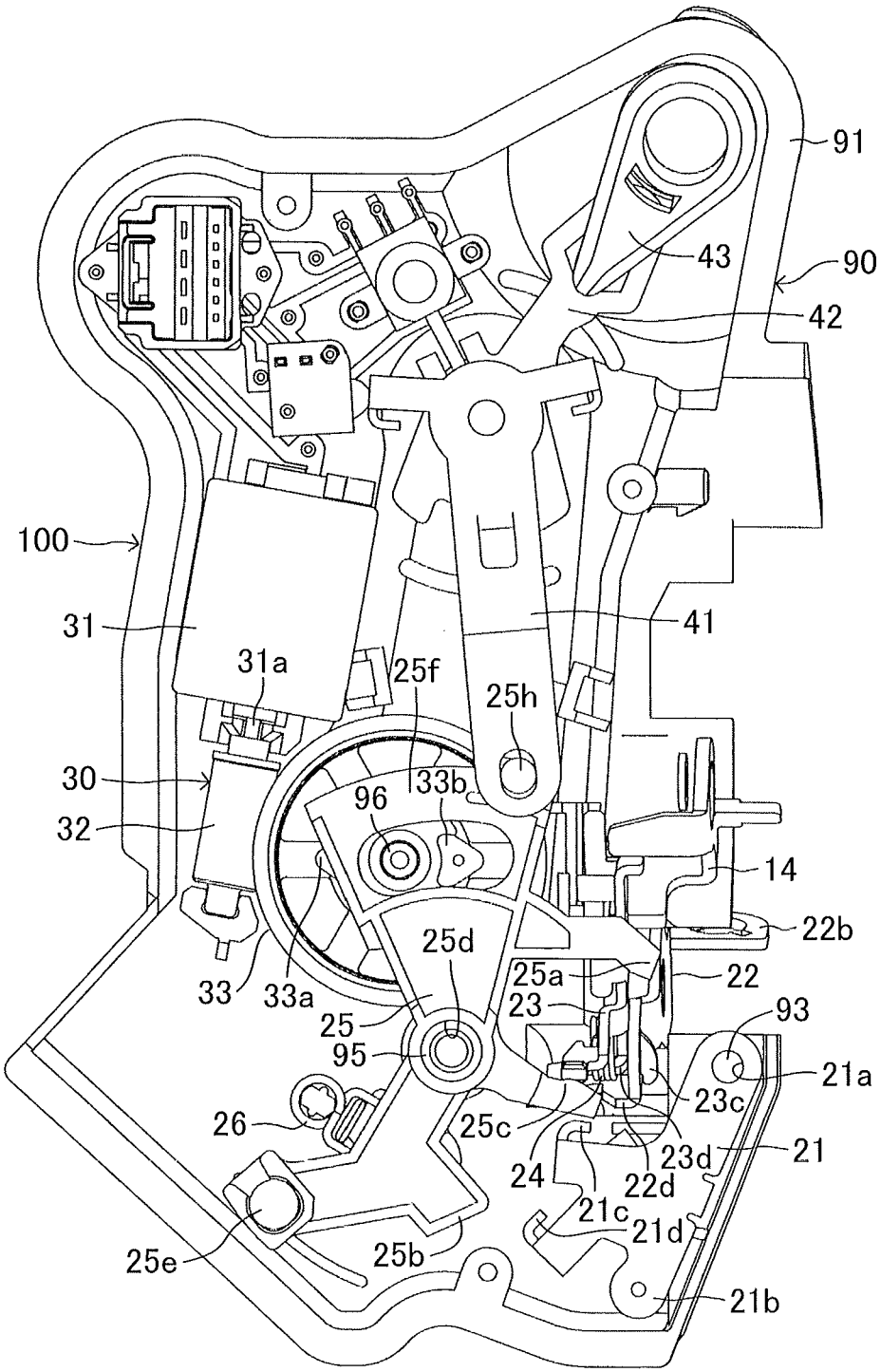
FIG. 4 is a side view for illustrating a state in which a latch mechanism, apart from a lift lever, an inner housing body of a housing, and the like are removed from the vehicle door lock device illustrated in FIG. 3.
Figure 5:
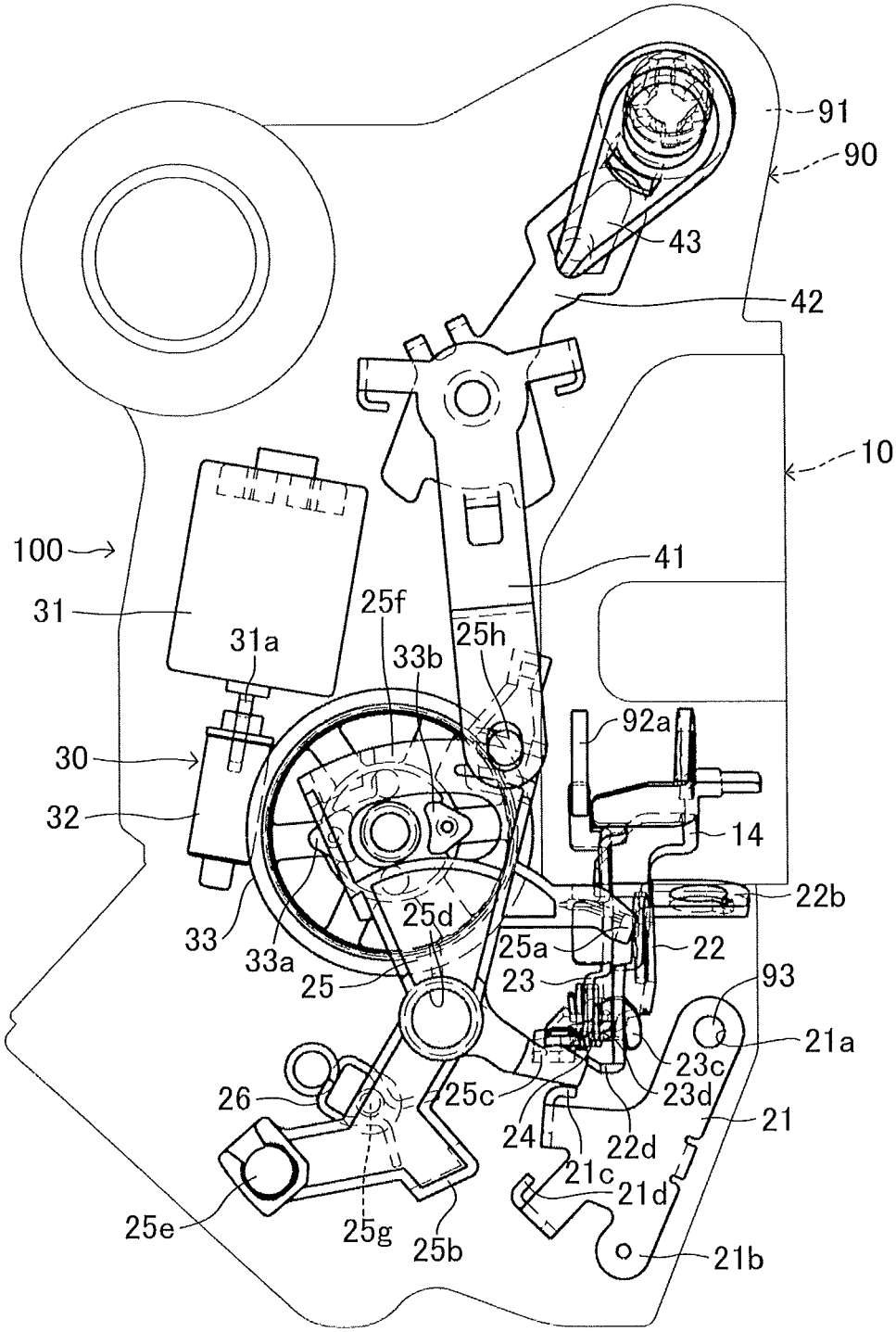
FIG. 5 is a side view for illustrating in detail main components of the vehicle door lock device (in a door-unlocked state) illustrated in FIG. 4.
Figure 8:
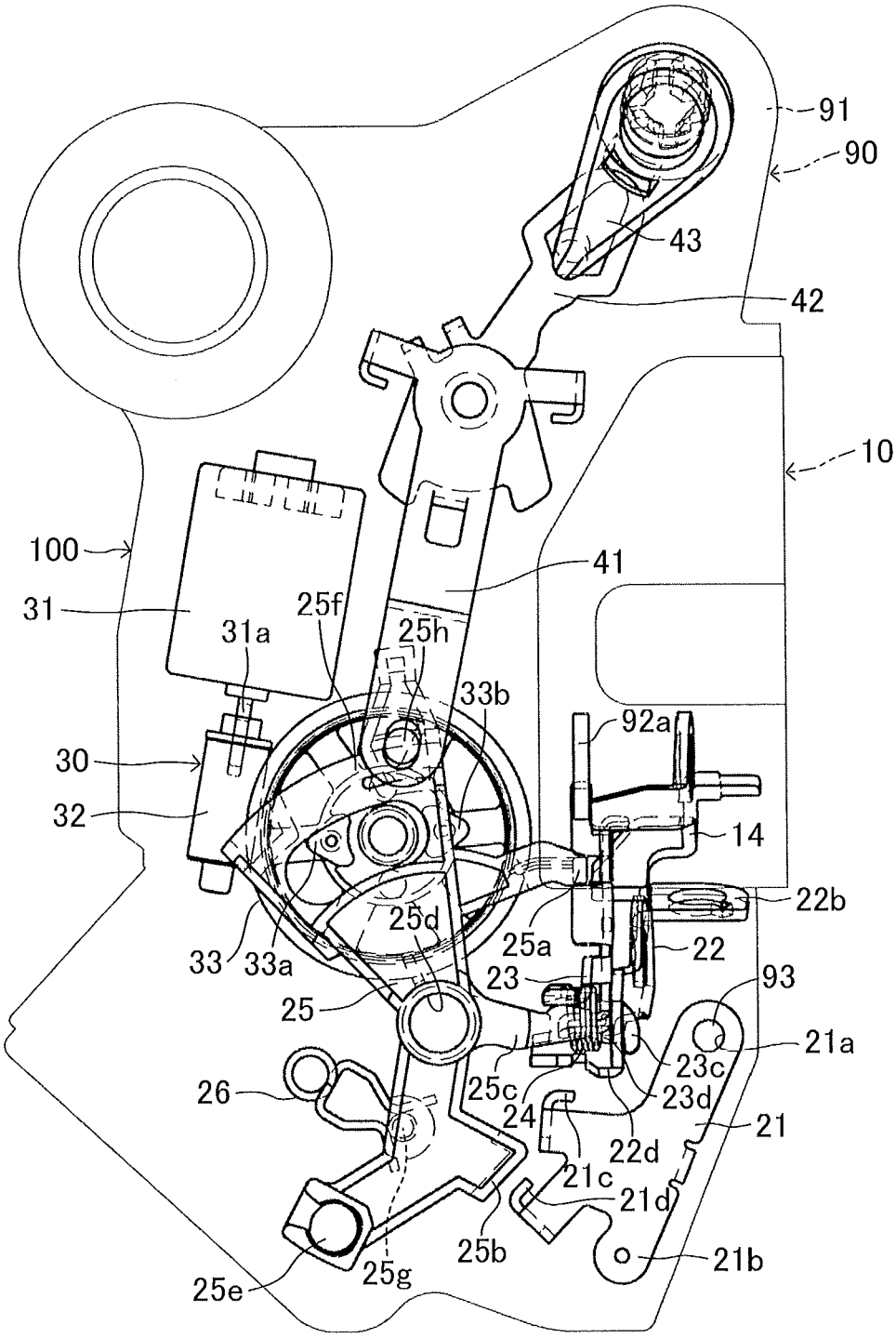
FIG. 8 is a side view corresponding to FIG. 5, for illustrating the vehicle door lock device illustrated in FIGS. 1 to 7 in a door-locked state.

The inside open lever 21 is rotationally driveable from an initial position (return position illustrated in FIGS. 4, 5, and 8) to an actuation position (position of FIG. 11 shifted from the return position illustrated in FIGS. 4, 5, and 8 in a clockwise direction by a predetermined angle of rotation) along with a door opening operation of an inside door handle 204 (see FIG. 17) which is provided on an inner side of the door 201. As illustrated in FIGS. 4, 5, and 8, the inside open lever 21 is rotatably assembled to the housing 90 through the intermediation of a support shaft 93 at a support hole 21*a*. The inside open lever 21 includes: an operation arm portion 21*b* linked to the inside door handle 204 through the intermediation of an operation cable W1 illustrated in FIGS. 1 and 3 (operating force transferring member such as a link may be used instead); a first push arm portion 21*c* engageable with and disengageable from an engagement arm portion 22*d* of the outside open lever 22; and a second push arm portion 21*d* engageable with and disengageable from a receiving portion 25*b* of the active lever 25.

The outside open lever 22 is rotationally driveable from an initial position (return position illustrated in FIGS. 6 and 9) to an actuation position (position illustrated in FIGS. 7 and 10) along with a door opening operation of an outside door handle 205 (see FIG. 17) which is provided on an outer side of the door 201, and is rotatably assembled to the housing 90 through the intermediation of a support shaft 94 at a support hole 22*a* arranged substantially orthogonal to the support hole 21 a of the inside open lever 21. The outside open lever 22 includes: an operation portion 22*b* linked to the outside door handle 205 through the intermediation of an operation force transferring member (not shown) such as a link; a coupling hole portion (coupling portion) 22*c* coupled to the open link 23; and the engagement arm portion 22*d* engageable with and disengageable from the first push arm portion 21*c* of the inside open lever 21. Note that, the outside open lever 22 is biased by an outside open lever spring (not shown) toward the initial position.

The open link 23 includes the push head portion 23*a* and the receiving body portion 23*b* mentioned above, and further includes a coupling leg portion 23*c* and a support portion 23*d* (see FIGS. 4 and 5). The open link 23 is assembled into the coupling hole portion (coupling portion) 22*c* of the outside open lever 22 at the coupling leg portion 23*c* so as to be capable of tilting by a predetermined degree in a right-and-left direction of FIG. 6 (that is, the open link 23 is arranged so as to be pivotable with respect to the housing 90 about a rotation axis whose direction is different from a direction of a rotation axis of the active lever 25 (about the coupling hole portion 22*c*)). The open link 23 supports the spring 24 at the support portion 23*d*. A main portion (push head portion 23*a*, receiving body portion 23*b*, and the like) of the open link 23 is tilted in a plane substantially parallel to the drawing sheet of FIG. 6, and this plane is disposed in parallel to a plane in which a main portion of the lift lever 14 rotates. Further, the open link 23 includes: an engagement leg portion 23*e* engageable with and disengageable from a push arm portion 25*c* of the active lever 25; an engagement arm portion 23*f* engageable with and disengageable from the unlocked state maintaining guide 92*a* of the housing 90; and an engagement body portion 23*g* engageable with and disengageable from the locked state maintaining guide 25*a* (see FIGS. 9 and 10) of the active lever 25.

Figure 7:
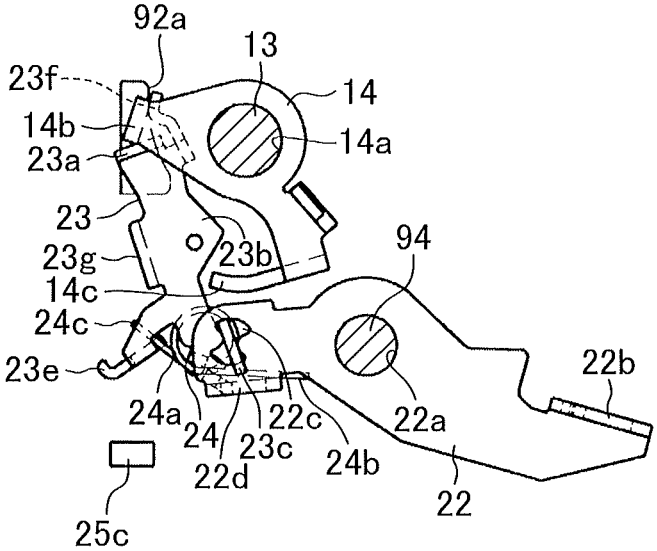
FIG. 7 is an explanatory view for illustrating an actuation of a state in which the outside open lever is actuated in a door opening direction in the configuration illustrated in FIG. 6.

When the inside open lever 21 is rotationally driven from the initial position to the actuation position or when the outside open lever 22 is rotationally driven from the initial position to the actuation position, the open link 23 is pushed from the initial position illustrated in FIG. 6 toward the lift lever 14, and is moved to an actuation position illustrated in FIG. 7. Further, when the active lever 25 moves from a locked position (position illustrated in FIG. 8) to an unlocked position (position illustrated in FIGS. 4 and 5), the open link 23 is switchable to an unlocked state (state illustrated in FIG. 6), and when the active lever 25 moves from the unlocked position to the locked position, the open link 23 is switchable to a locked state (state illustrated in FIG. 9).

Figure 9:
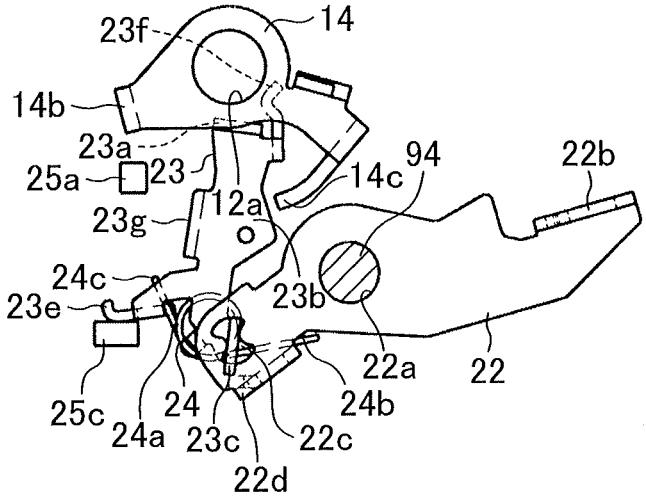
FIG. 9 is a view for illustrating a relationship in the vehicle width direction of the outside open lever, the spring, the open link, the active lever, and the lift lever, which are illustrated in FIG. 8, with respect to a locked state maintaining guide provided to the active lever.
Figure 10:
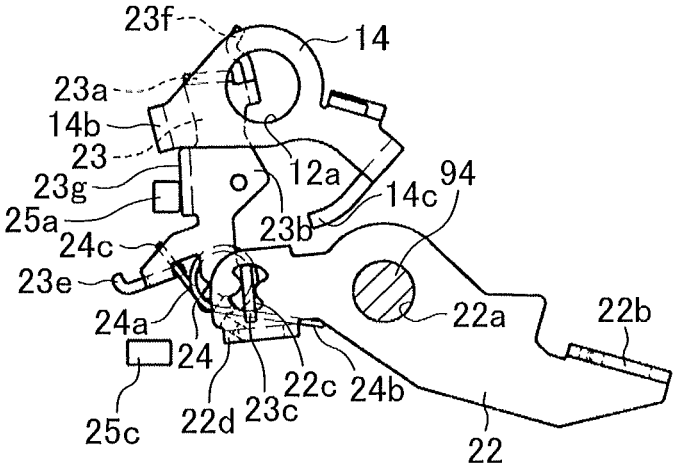
FIG. 10 is an explanatory view for illustrating an actuation of a state in which the outside open lever is actuated in the door opening direction in the configuration illustrated in FIG. 9.
Figure 11:
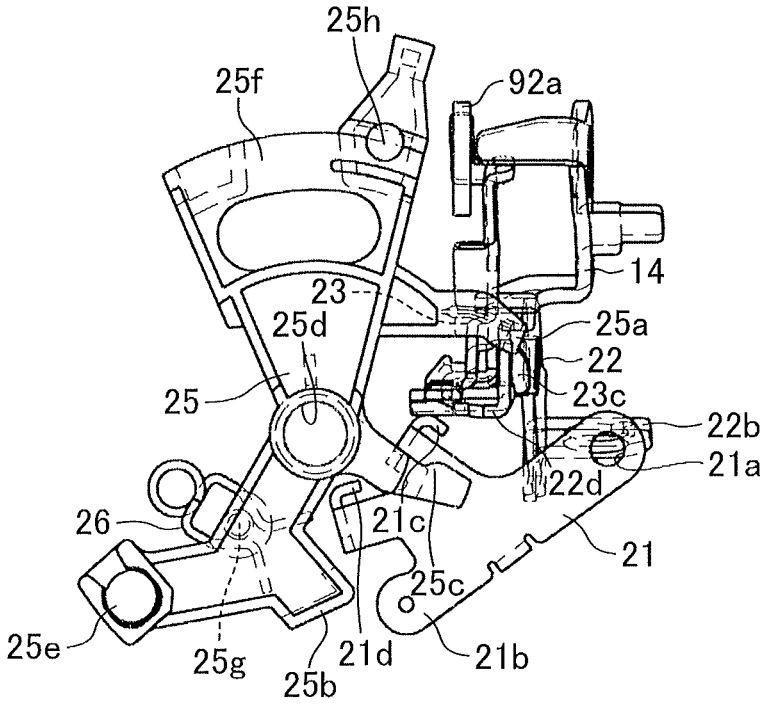
FIG. 11 is an explanatory view for illustrating a one-motion function of the vehicle door lock device illustrated in FIGS. 1 to 10.

Note that, when the open link 23 is held in the unlocked state, as illustrated in FIGS. 6 and 7, door opening actuations of the open levers 21 and 22 along with the door opening operations of the door handles 204 and 205 are transferred to the lift lever 14 via the open link 23, respectively. On the other hand, when the open link 23 is held in the locked state, as illustrated in FIGS. 9 and 10, the door opening actuations of the open levers 21 and 22 along with the door opening operations of the door handles 204 and 205 are transferred to the open link 23, but are not transferred from the open link 23 to the lift lever 14.

The spring 24 is interposed between the outside open lever 22 and the open link 23, and biases the open link 23 relative to the outside open lever 22 so that the open link 23 is brought into the unlocked state (state illustrated in FIG. 6). Further, the spring 24 includes: a coil portion 24*a* assembled to the support portion 23*d* of the open link 23; and a pair of arm portions 24*b* and 24*c* extending radially outward from end portions of the coil portion 24*a*. The arm portion 24*b* on one side engages with the outside open lever 22, and the arm portion 24*c* on the other side engages with the open link 23.

Figure 17:
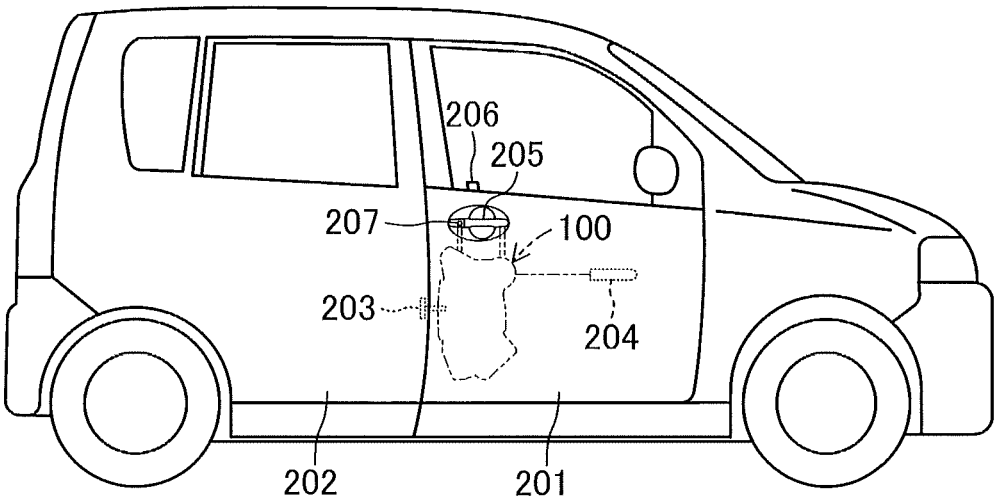
FIG. 17 is a right side view for illustrating a vehicle including the vehicle door lock device illustrated in FIGS. 1 to 16.

Thus, in the door-locked state (state in which the door is locked), when the door handles 204, 205 illustrated in FIG. 17 and a lock/unlock operation member (lock knob 206 provided on the inner side of the door 201, key cylinder 207 capable of being operated from the outer side of the door 201, remote control device for actuating an electric motor 31 of an electric driving mechanism 30, or the like) are operated simultaneously and thus the vehicle door lock device 100 is brought into a panic state (see FIG. 12), owing to the function of the spring 24, the open link 23 is biased so that the open link 23 is brought into the unlocked state, and is retained elastically and relatively movable to the engagement arm portion 14*b* of the lift lever 14. In this manner, the open link 23 is permitted to return to the initial position illustrated in FIG. 6.

Through a locking operation of the lock/unlock operation member, the active lever 25 is switched from the unlocked position illustrated in FIGS. 4 and 5 to the locked position illustrated in FIG. 8 so as to bring the open link 23 into the locked state. Further, through an unlocking operation of the lock/unlock operation member, the active lever 25 is switched from the locked position to the unlocked position so as to bring the open link 23 into the unlocked state. The active lever 25 is rotatably assembled to the housing 90 through the intermediation of a support shaft 95 at a support hole 25*d* formed in a boss portion of the active lever 25.

The active lever 25 includes the locked state maintaining guide 25*a*, the receiving portion 25*b*, the push arm portion 25*c*, and the support hole 25*d* mentioned above. The active lever 25 further includes: an operation portion 25*e* coupled through the intermediation of an operation cable W2 illustrated in FIGS. 1 and 3 to the lock knob 206 provided on the inner side of the door 201; a driving portion 25*f* linked to the electric driving mechanism 30; an engagement pin portion 25*g* (see FIG. 5) linked to a positioning spring 26; and an engagement pin portion 25*h* linked through the intermediation of a locking control lever 41, a key switch lever 42, an outside locking lever 43, and the like to the key cylinder 207 provided on the outer side of the door 201. Note that, the active lever 25 is retained at the unlocked position or the locked position by the positioning spring 26 which is assembled within the housing 90 and engaged with the engagement pin portion 25*g* (see FIG. 5) provided to the active lever 25.

When the active lever 25 is at the unlocked position illustrated in FIGS. 5 and 6 and the open link 23 is in the unlocked state, the push arm portion 25*c* is engaged with the engagement leg portion 23*e* of the open link 23 so as to tilt the open link 23 through switching of the active lever 25 from the unlocked position (position illustrated in FIG. 6) to the locked position (position illustrated in FIG. 9). On the other hand, when the active lever 25 is at the locked position illustrated in FIGS. 8 and 9 and the open link 23 is in the locked state, the push arm portion 25*c* can be disengaged from the open link 23 so as to permit the open link 23 to shift to the unlocked state.

The electric driving mechanism 30 drives the active lever 25 between the locked position and the unlocked position, and includes the electric motor 31, a worm 32, and a worm wheel 33. Together with the active lever 25, the electric driving mechanism 30 forms an electric actuator for switching the open link 23 between the unlocked position and the locked position described above.

The electric motor 31 is a publicly-known motor to be driven in accordance with the lock operation and the unlock operation of the lock/unlock operation member such as the remote control device. The worm 32 forms a gear unit together with the worm wheel 33. The worm 32 is provided integrally with an output shaft 31*a* of the electric motor 31, and is rotationally driven by the electric motor 31. The worm wheel 33 is arranged on the outer side of the active lever 25 (on the outer housing body 91 side), and is rotatably assembled to the housing 90 through the intermediation of a support shaft 96 (see FIG. 4). The worm wheel 33 is always meshed with the worm 32, and includes a pair of cams 33*a*, 33*b* which are linked to a pair of cam followers (illustrated by broken lines in FIG. 5, though detailed description thereof is omitted) provided to the driving portion 25*f* of the active lever 25.

The respective cams 33*a*, 33*b* are rotatably assembled to the inner side of the worm wheel 33 (active lever 25 side), and form a converting mechanism (cam mechanism) together with the respective cam followers provided on a wall surface of the driving portion 25*f* of the active lever 25 on the worm wheel 33 side. The converting mechanism is provided between the active lever 25 and the gear unit including the worm 32 and the worm wheel 33, and converts rotation of the worm wheel 33 (that is, motion of the gear unit) into tilting of the active lever 25.

Accordingly, in the electric driving mechanism 30, when the active lever 25 is at the unlocked position illustrated in FIGS. 4 and 5 and the locking operation is performed on the lock/unlock operation member (for example, remote control device for actuating the electric motor 31), the worm wheel 33 is rotationally driven by 180 degrees in a counterclockwise direction by the electric motor 31 through the intermediation of the worm 32, to thereby move (tilt) the active lever 25 to the locked position illustrated in FIG. 8. Further, when the active lever 25 is at the locked position illustrated in FIG. 8 and the unlocking operation is performed on the lock/unlock operation member, the worm wheel 33 is rotationally driven by 180 degrees in the clockwise direction by the electric motor 31 through the intermediation of the worm 32, to thereby move (tilt) the active lever 25 to the unlocked position illustrated in FIGS. 4 and 5.

Further, in this embodiment, as illustrated in FIGS. 5, 6, and 7, the unlocked state maintaining guide 92*a* provided to the inner housing body 92 of the housing 90 maintains the open link 23, which is disengaged from the push arm portion 25*c* of the active lever 25, in the unlocked state when the active lever 25 is at the unlocked position and the outside open lever 22 is rotated between the initial position and the actuation position. When the unlocked state maintaining guide 92*a* maintains the open link 23 in the unlocked state, as illustrated in FIG. 7, the engagement arm portion 23*f* of the open link 23 is slideably engaged with the unlocked state maintaining guide 92*a*. Note that, a shape of a guide surface (surface on which the engagement arm portion 23*f* is slideably engaged) of the unlocked state maintaining guide 92*a* is set in consideration of a trajectory of movement of an engagement portion between the engagement arm portion 14*b* of the lift lever 14 and the push head portion 23*a* of the open link 23. It is desired that the shape of the guide surface be set so as to prevent occurrence of slip on the above-mentioned engagement portion.

On the other hand, as illustrated in FIGS. 8, 9, and 10, the locked state maintaining guide 25*a* of the active lever 25 maintains the open link 23, which is disengaged from the push arm portion 25*c* of the active lever 25, in the locked state when the active lever 25 is at the locked position and the outside open lever 22 is rotated between the initial position and the actuation position. When the locked state maintaining guide 25*a* maintains the open link 23 in the locked state, as illustrated in FIG. 10, the engagement body portion 23*g* of the open link 23 is slideably engaged with the locked state maintaining guide 25*a*.

Further, in this embodiment, as illustrated in FIG. 9, the lift lever 14 is arranged in such a manner that the push leg portion 14*c* thereof can push the receiving body portion 23*b* of the open link 23 when the door 201 in an opened state is closed under a state in which the active lever 25 is at the locked position and the outside open lever 22 is at the initial position (at this time, as is well known, the rotation shaft portion of the pawl 13 is temporarily rotated by a predetermined degree in the clockwise direction of FIG. 9 integrally with the lift lever 14). Further, as illustrated in FIG. 8, the inside open lever 21 is arranged in such a manner that the second push arm portion 21*d* thereof can push the receiving portion 25*b* of the active lever 25 when the inside door handle 204 is operated to open the door under a state in which the active lever 25 is at the locked position and the inside open lever 21 is at the initial position.

Further, in this embodiment, when the inside door handle 204 is operated to open the door, a timing at which the second push arm portion 21*d* of the inside open lever 21 is engaged with the receiving portion 25*b* of the active lever 25 is set earlier by a predetermined period of time than a timing at which the first push arm portion 21*c* of the inside open lever 21 is engaged with the engagement arm portion 22*d* of the outside open lever 22. With this setting, a so-called one-motion function can be obtained.

By the way, in this embodiment, the open link 23 is arranged so as to be pivotable with respect to the housing 90 about a rotation axis (about the coupling hole portion 22*c*) whose direction is different from the direction (direction orthogonal to the drawing sheet of FIG. 4) of the rotation axis of the active lever 25 and the worm wheel 33. Further, the latch mechanism 10 and the electric motor 31 are arranged at the same level (the same height level) with respect to the housing 90, and the worm wheel 33 is arranged below and between the latch mechanism 10 and the electric motor 31. Further, the housing 10 includes: the outer housing body 91 (see FIGS. 1 and 15) including a covering portion 91 a covering the outer sides of the electric motor 31, the worm 32, etc., an outer shaft-supporting portion 91*b* supporting the active lever 25, and an outer shaft-supporting portion 91*c* supporting the worm wheel 33; and the inner housing body 92 (see FIG. 3) including an inner shaft-supporting portion 92*b* supporting the active lever 25, and an inner shaft-supporting portion 92*c* supporting the worm wheel 33. The above-mentioned same level means that, under a state in which the vehicle door lock device 100 is assembled to the door 201, the electric motor 31 is arranged so as to overlap a plane of the latch mechanism 10 projected along a fore-and-aft direction of the door 201 (see FIGS. 2 and 5).

Figure 15:
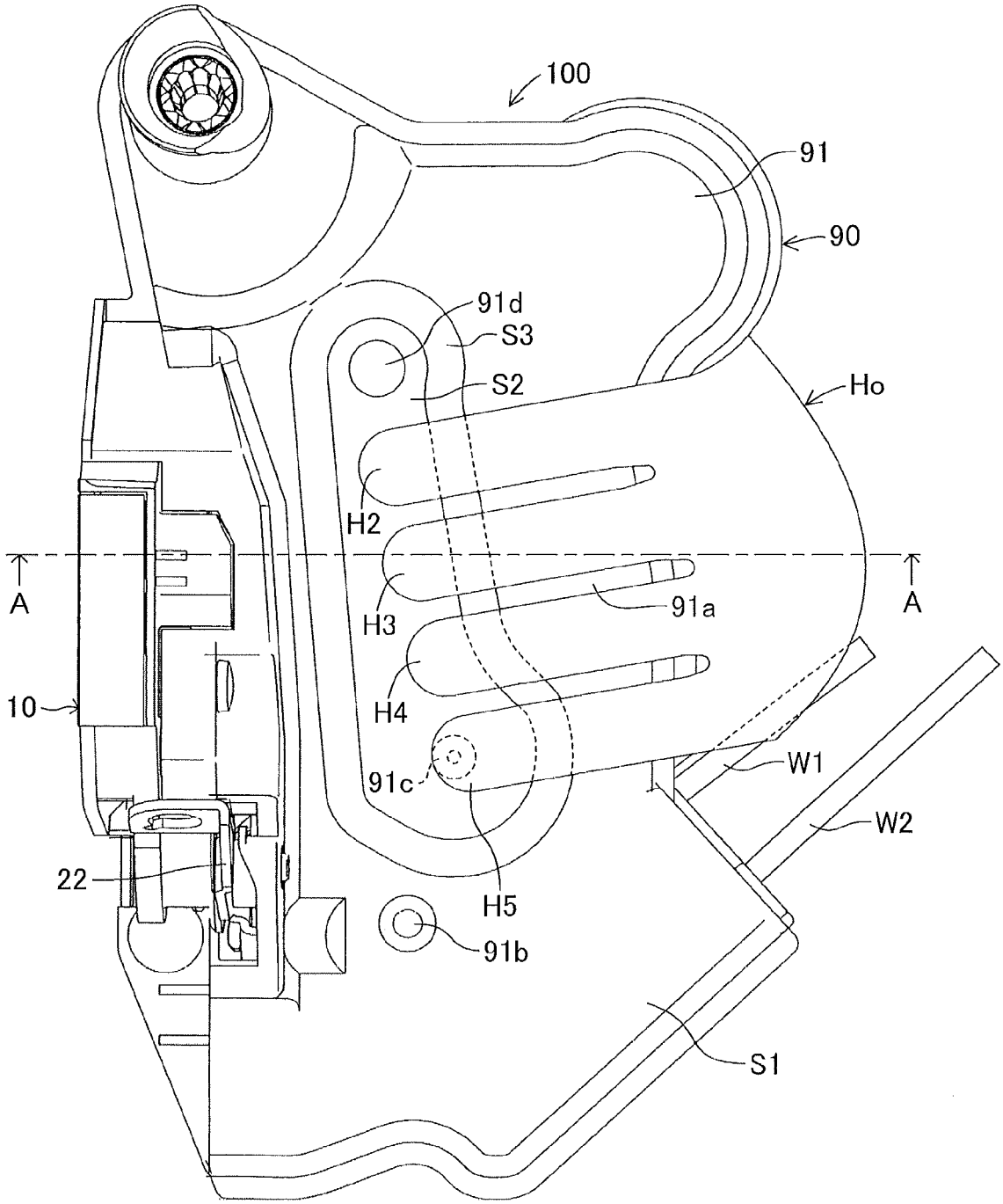
FIG. 15 is a view for illustrating a state in which the vehicle door lock device illustrated in FIG. 1 is held in hand.
Figure 16:
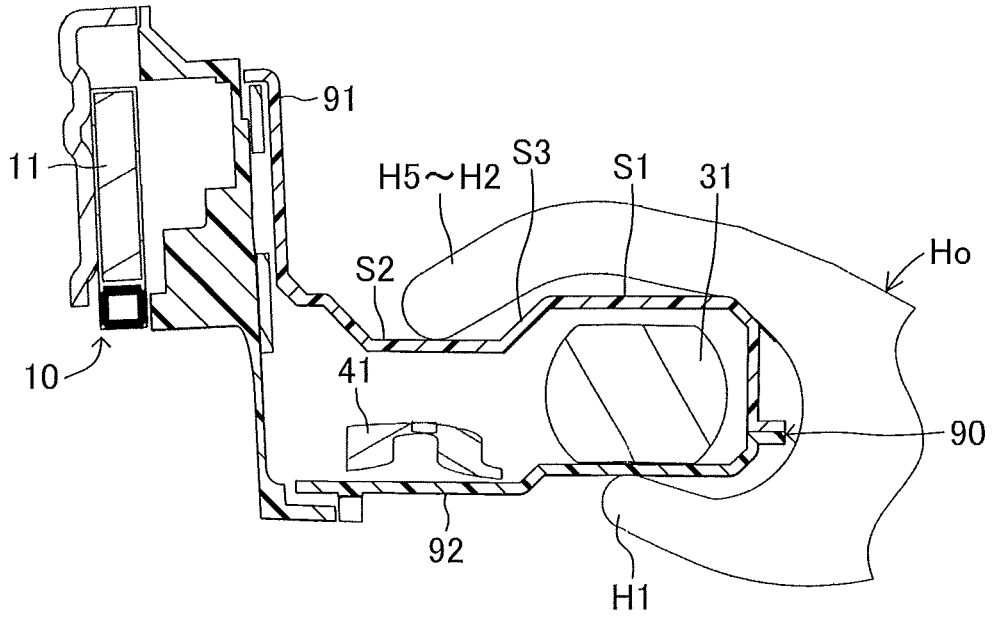
FIG. 16 is a schematic sectional view taken along the line A-A of FIG. 15.

Further, in this embodiment, as illustrated in FIGS. 1, 15, and 16, an outer surface of the covering portion 91*a* of the outer housing body 91 and an outer surface of the outer shaft-supporting portion 91 b of the outer housing body 91 are formed in the same flat surface S1, the outer shaft-supporting portion 91*b* supporting the active lever 25. An outer surface of the outer shaft-supporting portion 91*c* of the outer housing body 91 is formed in a dented surface S2 dented inwardly by a predetermined degree with respect to the above-mentioned flat surface S1, the outer shaft-supporting portion 91*c* supporting the worm wheel 33. The dented surface S2 is formed into a shape elongated in an up-and-down direction.

Further, in this embodiment, the locking control lever 41 is provided within the housing 90, and an outer surface of an outer shaft-supporting portion 91*d*, which is provided in the outer housing body 91, for supporting the locking control lever 41, is level and continuous with the above-mentioned dented surface S2.

Accordingly, in the vehicle door lock device 100 according to the above-mentioned embodiment, the active lever 25 and the worm wheel 33 can be arranged close to the latch mechanism 10, and hence increase in size of the housing 90 can be prevented. In addition, it is not necessary that the open link 23 be arranged so as to overlap the worm wheel 33 and the active lever 25 in the direction of the rotation axis of the active lever 25. Thus, in a portion of the outer housing body 91 of the housing 90 in which the worm wheel 33 is arranged (that is, portion in which the open link 23 is not arranged), it is possible to form the dented surface S2 dented inwardly with respect to the flat surface S1 of the outer housing body 91 (that is, general surface in which the outer surface of the covering portion 91*a* covering the outer sides of the electric motor 31 and the worm 32, and the outer surface of the outer shaft-supporting portion 91*b* supporting the active lever 25 are formed at the same level).

Further, the latch mechanism 10 and the electric motor 31 (which are made of a considerable amount of a metal material, and both are parts having large weight) are dispersed and arranged in a balanced manner with respect to the housing 90 along the right-and-left direction of FIGS. 1 and 15 (vehicle fore-and-aft direction of the door). Accordingly, the device 100 has a good weight balance with respect to a portion to be held in a hand Ho (center portion of the housing 90 in which the worm wheel 33 is arranged), and hence the device 100 can be held in a stable state. Further, as illustrated in FIGS. 15 and 16, the dented surface S2, which is dented inwardly with respect to the flat surface S1 and formed into a shape elongated in the up-and-down direction, is formed in the portion of the outer housing body 91 of the housing 90 in which the worm wheel 33 is arranged. Thus, a worker can hold the portion of the housing 90, in which the worm wheel 33 is arranged, in the hand Ho in the following manner. Specifically, a thumb H1 of the hand Ho is put on an inner surface of the inner housing body 92, and an index finger H2, a middle finger H3, etc. of the hand Ho are put on the dented surface S2 formed in the outer surface of the outer housing body 91. At this time, a step S3 formed between the flat surface S1 and the dented surface S2 in the outer housing body 91 of the housing 90 can be used to prevent slip of the index finger H2, the middle finger H3, etc. of the hand Ho, and hence a rib or a textured shape (concavo-convex shape) for preventing slip does not need to be additionally formed in the outer housing body 91 of the housing 90.

Accordingly, when the vehicle door lock device 100 is assembled to the door 201 of the vehicle while the vehicle door lock device 100 is held by a worker in the hand Ho, the portion of the device 100 to be held in the hand Ho is less likely to cause slip, and hence is easily held in the hand Ho. Therefore, it is possible to achieve satisfactory workability when the device 100 is assembled to the door 201 (workability when a worker holds the device 100 in the hand Ho, and assembles the device 100 to the door 201 while carrying the device 100 from the inner side of the door 201 into an inside of the door). Further, in the device 100, the rib or the textured shape (concavo-convex shape) for preventing slip does not need to be additionally formed in the outer housing body 91 of the housing 90, and hence it is also possible to reduce cost.

Further, in this embodiment, the outer surface of the outer shaft-supporting portion 91*c*, which is provided in the outer housing body 91, for supporting the worm wheel 33, is formed in the dented surface S2 dented inwardly with respect to the flat surface S1. Thus, when compared to a case where the outer surface of the outer shaft-supporting portion, which is provided in the outer housing body, for supporting the worm wheel, is formed at the same level as that of the flat surface S1, it is possible to reduce an axial length of the outer shaft-supporting portion 91*c* provided in the outer housing body 91, for rotatably supporting the worm wheel 33, and hence it is possible to increase manufacturing accuracy of the outer shaft-supporting portion 91*c*. Accordingly, it is possible to increase accuracy of assembly of the worm wheel 33 to the housing 90, and to increase meshing accuracy between the worm 32 and the worm wheel 33.

Further, in this embodiment, the outer surface of the outer shaft-supporting portion 91*d*, which is provided in the outer housing body 91, for supporting the locking control lever 41, is level and continuous with the above-mentioned dented surface S2. Thus, a length of the dented surface S2 in the up-and-down direction enables all of the index finger H2, the middle finger H3, a ring finger H4, a little finger H5, etc. of the hand Ho to be easily put onto the dented surface S2, and hence the device 100 can be appropriately held in the five fingers H1 to H5 of the hand Ho.

Note that, in the vehicle door lock device 100 according to this embodiment configured as described above, each component is actuated in the following manner in each case described in the following items: (a) when the inside door handle 204 is operated to open the door in a door-unlocked state (state in which the door 201 is unlocked); (b) when the outside door handle 205 is operated to open the door in the door-unlocked state; (c) when the outside door handle 205 is operated to open the door in a door-locked state (state in which the door 201 is locked); (d) when the inside door handle 204 is operated to open the door in the door-locked state; (e) when the door 201 in the opened state is brought into the door-locked state, and then the door 201 is closed without operating the door handles 204, 205; and (f) when the door 201 in the opened state is brought into the door-locked state, and then the door 201 is closed under a state in which the outside door handle 205 is operated to open the door.

"(a) Actuation when the Inside Door Handle 204 is Operated to Open the Door in the Door-Unlocked State"

When the vehicle door lock device 100 is in the door-unlocked state as illustrated in FIGS. 3 to 6 under a state in which the door 201 is closed, the inside open lever 21 is actuated in the door opening direction (clockwise direction of FIGS. 4 and 5) along with the door opening operation of the inside door handle 204. Then, as illustrated in FIGS. 6 and 7, the open link 23 in the unlocked state is moved from the initial position (position illustrated in FIG. 6) to the actuation position illustrated in FIG. 7 by the outside open lever 22 pushed by the inside open lever 21, and thus the lift lever 14 is rotated in an unlatching direction (clockwise direction of FIG. 6). Accordingly, the actuation of the inside open lever 21 in the door opening direction is transferred to the lift lever 14 through the intermediation of the outside open lever 22 and the open link 23, with the result that the lift lever 14 is rotated in the unlatching direction and the latch mechanism 10 is brought into an unlatched state from a latched state. In this manner, the door 201 can be opened.

"(b) Actuation when the Outside Door Handle 205 is Operated to Open the Door in the Door-Unlocked State"

Further, when the vehicle door lock device 100 is in the unlocked state as illustrated in FIGS. 3 to 6 under a state in which the door 201 is closed, the outside open lever 22 is actuated in the door opening direction (clockwise direction of FIG. 6) along with the door opening operation of the outside door handle 205. Then, as illustrated in FIGS. 6 and 7, the open link 23 in the unlocked state is moved from the initial position (position illustrated in FIG. 6) to the actuation position illustrated in FIG. 7 by the outside open lever 22, and thus the lift lever 14 is rotated in the unlatching direction. Accordingly, the actuation of the outside open lever 22 in the door opening direction is transferred to the lift lever 14 through the intermediation of the open link 23, with the result that the lift lever 14 is rotated in the unlatching direction and the latch mechanism 10 is brought into the unlatched state from the latched state. In this manner, the door 201 can be opened.

"(c) Actuation when the Outside Door Handle 205 is Operated to Open the Door in the Door-Locked State"

Further, when the vehicle door lock device 100 is in the door-locked state as illustrated in FIGS. 8 and 9 under a state in which the door 201 is closed, the outside open lever 22 is actuated in the door opening direction along with the door opening operation of the outside door handle 205. Then, the open link 23 in the locked state illustrated in FIG. 9 is lifted in the locked state illustrated in FIG. 10 while being guided by the locked state maintaining guide 25*a* provided to the active lever 25, and hence is not engaged with the lift lever 14. Thus, the actuation of the outside open lever 22 in the door opening direction is not transferred to the lift lever 14, with the result that the lift lever 14 is not rotated and the latch mechanism 10 is maintained in the latched state. Therefore, the door 201 cannot be opened.

"(d) Actuation when the Inside Door Handle 204 is Operated to Open the Door in the Door-Locked State"

On the other hand, when the vehicle door lock device 100 is in the door-locked state as illustrated in FIGS. 8 and 9 under a state in which the door 201 is closed, the inside open lever 21 is actuated in the door opening direction along with the door opening operation of the inside door handle 204. Then, the timing at which the second push arm portion 21*d* of the inside open lever 21 is engaged with the receiving portion 25*b* of the active lever 25 is earlier by a predetermined period of time than the timing at which the first push arm portion 21*c* of the inside open lever 21 is engaged with the engagement arm portion 22*d* of the outside open lever 22, and hence the open link 23 in the locked state illustrated in FIG. 9 is shifted to the unlocked state illustrated in FIG. 6 by the time the first push arm portion 21*c* of the inside open lever 21 is engaged with the engagement arm portion 22*d* of the outside open lever 22. Thus, after that, the same actuation as the actuation described in the item (a) is obtained. In this manner, it is possible to open the door 201, and to obtain a so-called one-motion function (function capable of opening the door 201 in the door-locked state through one-time door opening operation).

"(e) Actuation when the Door 201 in the Opened State is Brought into the Door-Locked State, and then the Door 201 is Closed Without Operating the Door Handles 204, 205"

Further, in this embodiment, the push leg portion 14*c* is provided to the lift lever 14 of the vehicle door lock device 100, and the receiving body portion 23*b* is provided to the open link 23. Accordingly, under a state in which the door is opened, when the door is brought into the door-locked state as illustrated in FIGS. 8 and 9 through, for example, a locking operation of the lock knob 206, and then the door 201 in this state is closed without operating the door handles 204, 205, as is well known, the latch 11 of the latch mechanism 10 is engaged with the striker (not shown), and the rotation shaft portion of the pawl 13 is temporarily rotated by a predetermined degree in the clockwise direction of FIG. 9 integrally with the lift lever 14 and then returned to an original state. Thus, when the door 201 is closed, the push leg portion 14*c* of the lift lever 14 illustrated in FIG. 9 is actuated to push the receiving body portion 23*b* of the open link 23.

Figure 13:
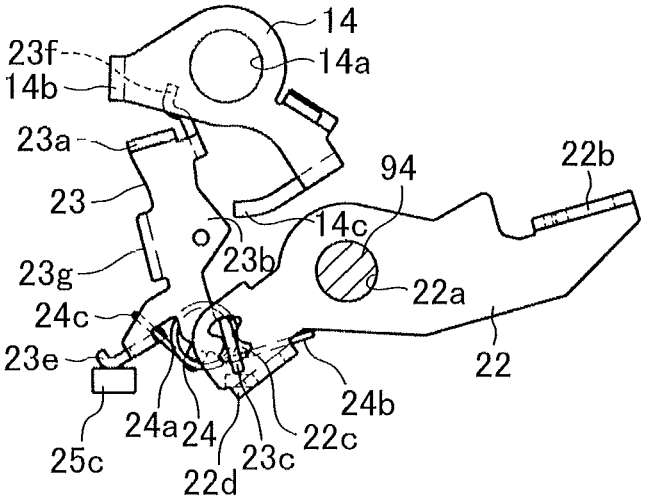
FIG. 13 is an explanatory view for illustrating an actuation of a canceling function of the vehicle door lock device illustrated in FIGS. 1 to 10.

With this, the open link 23 and the push arm portion 25*c* of the active lever 25 are shifted from the locked state illustrated in FIG. 9 to the unlocked state illustrated in FIG. 13, and thus the door-locked state is automatically cancelled. Therefore, at this time, an unlocking actuation is obtained through closing the open door in the door-locked state, and the door-locked state illustrated in FIGS. 8 and 9 is shifted to the door-unlocked state illustrated in FIGS. 3 to 6, and 13. In this manner, it is possible to prevent so-called key confinement.

"(f) Actuation when the Door 201 in the Opened State is Brought into the Door-Locked State, and then the Door 201 is Closed Under a State in Which the Outside Door Handle 205 is Operated to Open the Door"

Figure 14:
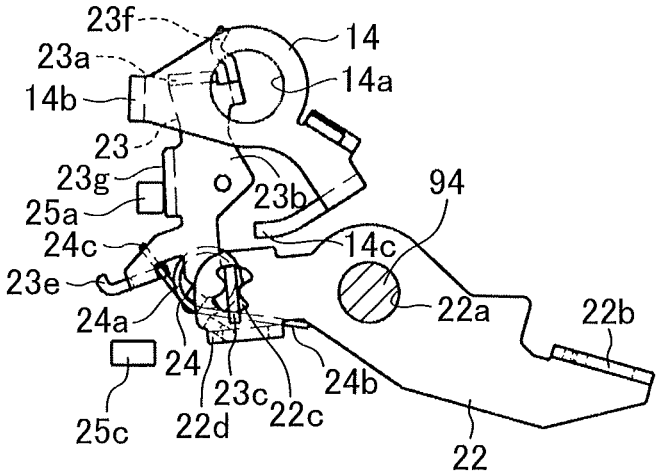
FIG. 14 is an explanatory view for illustrating an actuation of a keyless locking function of the vehicle door lock device illustrated in FIGS. 1 to 10.

The unlocking actuation obtained through the door closing operation described in the item (e) can be cancelled in the following manner. Specifically, under a state in which the door 201 is opened, after the lock knob 206 is subjected to the locking operation to be brought into the door-locked state as illustrated in FIGS. 8 and 9, the outside door handle 205 is operated to open the door, and the door 201 in this state is closed. In this case, the state illustrated in FIG. 9 is shifted to the state illustrated in FIG. 114 (at the time of closing the door 201, when the rotation shaft portion of the pawl 13 is temporarily rotated by a predetermined degree integrally with the lift lever 14 and then returned to the original state, the push leg portion 14*c* of the lift lever 14 is actuated to fail to strike the open link 23). Thus, the open link 23 is maintained in the locked state, and the active lever 25 is maintained at the locked position. Accordingly, when the outside door handle 205 is returned to an original position thereafter, the outside open lever 22, the open link 23, the spring 24, and the like in the state illustrated in FIG. 14 are returned to the state illustrated in FIG. 9, and thus the door-locked state is maintained. As a result, keyless lock can be obtained.

Figure 12:
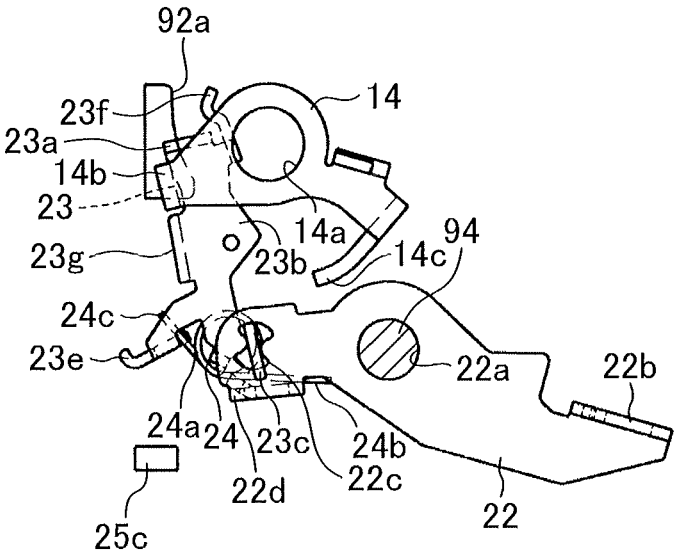
FIG. 12 is an explanatory view for illustrating an actuation of a panic state of the vehicle door lock device illustrated in FIGS. 1 to 10 (state in which the outside open lever illustrated in FIG. 9 is actuated in the door opening direction, the active lever illustrated in FIG. 9 is moved toward an unlocked position, and the open link is engaged with the lift lever).

Further, in the vehicle door lock device 100 according to the above-mentioned embodiment, the spring 24 interposed between the outside open lever 22 and the open link 23 biases the open link 23 so that the open link 23 is brought into the unlocked state, and retains the open link 23 movable relative to the lift lever 14 so as to permit the open link 23 to return to the initial position. Further, the push arm portion 25*c* of the active lever 25 is disengageable from the open link 23 so as to permit the open link 23 in the locked state to shift to the unlocked state. Accordingly, in the door-locked state (state in which the door 201 is locked), when the door handles 204, 205 and the lock/unlock operation member are operated simultaneously to cause the panic state, as illustrated in FIG. 12, the open link 23 is retained movable relative to the lift lever 14, and is permitted to return to the initial position. Therefore, even in the above-mentioned panic state, through returning the outside open lever 22 to the initial position, the open link 23 is returned to the initial position while being brought into the unlocked state. Thus, it is possible to smoothly perform switching to the door-unlocked state (state in which the door 201 is unlocked).

Further, in the vehicle door lock device 100 according to the above-mentioned embodiment, when the panic state occurs as described above, as illustrated in FIG. 12, the spring 24 interposed between the outside open lever 22 and the open link 23 functions in the above-mentioned manner. Thus, it is not necessary to interpose a spring in the active lever 25 itself, and hence the active lever 25 can be formed of a single member. Accordingly, components ranging from the active lever 25 to the open link 23 can be formed of three components such as the active lever 25, the spring 24, and the open link 23, and hence the vehicle door lock device 100 can be formed simply at low cost.

Further, in the vehicle door lock device 100 according to the above-mentioned embodiment, as illustrated in FIG. 6, the push leg portion 14*c* is provided to the lift lever 14, and the receiving body portion 23*b* is provided to the open link 23. Thus, under a state in which the door 201 is opened, when the active lever 25 is switched from the unlocked position to the locked position through the locking operation of the lock/unlock operation member to bring the door into the door-locked state, and then the door 201 in this state is closed without operating the door handles 204, 205, the push leg portion 14*c* of the lift lever 14 is actuated to push the receiving body portion 23*b* of the open link 23. Accordingly, with use of this actuation, the open link 23 can be shifted from the locked state to the unlocked state, and the active lever 25 can be moved from the locked position to the unlocked position. Therefore, in this case, through closing the open door 201 in the door-locked state, the door-locked state can be automatically cancelled.

Further, in the above-mentioned embodiment, the plane of rotation of the main portion of the lift lever 14 and the plane of tilting of the main portion of the open link 23 are arranged in parallel to each other, the push leg portion 14*c* is provided to the lift lever 14, and the receiving body portion 23*b* is provided to the open link 23. With this configuration, the present invention can be carried out. Further, it is possible to add the above-mentioned canceling function without increasing the number of components. Thus, the present invention can be carried out simply at low cost.

Further, in the above-mentioned embodiment, as illustrated in FIGS. 4 and 5, the second push arm portion 21*d* is provided to the inside open lever 21, and the receiving portion 25*b* is provided to the active lever 25. Accordingly, when the inside door handle 204 is operated to open the door under a state in which the door 201 is closed and the active lever 25 is at the locked position, the inside open lever 21 is actuated in the door opening direction, and the second push arm portion 21*d* of the inside open lever 21 is actuated to push the receiving portion 25*b* of the active lever 25. Thus, with use of this actuation, the active lever 25 can be moved from the locked position to the unlocked position, and the open link 23 can be shifted from the locked state to the unlocked state. Therefore, in this case, in the closed door 201 in the door-locked state, the door-locked state can be automatically cancelled through the door opening operation of the inside door handle 204. In this manner, a so-called one-motion function can be obtained.

By the way, in this case, the present invention can be carried out with such a configuration that the second push arm portion 21*d* is provided to the inside open lever 21 and the receiving portion 25*b* is provided to the active lever 25, and it is possible to add the above-mentioned one-motion function without increasing the number of components. Thus, the present invention can be carried out simply at low cost.

In the above-mentioned embodiment, when the inside door handle 204 is operated to open the closed door 201 in the door-locked state, the timing at which the second push arm portion 21*d* of the inside open lever 21 is engaged with the receiving portion 25*b* of the active lever 25 (timing at which the active lever 25 starts to be driven by the inside open lever 21 toward the unlocked position) is set earlier by a predetermined period of time than the timing at which the first push arm portion 21*c* of the inside open lever 21 is engaged with the engagement arm portion 22*d* of the outside open lever 22 (timing at which the outside open lever 22 starts to be driven by the inside open lever 21 toward the actuation position), and thus the one-motion function (lock releasing function provided through a single pulling operation of the inside door handle) is established. In this manner, the present invention is carried out. However, the present invention can be carried out in the following manner. Specifically, the timing at which the active lever 25 starts to be driven by the inside open lever 21 toward the unlocked position is set later by a predetermined period of time than the timing at which the outside open lever 22 starts to be driven by the inside open lever 21 toward the actuation position, and thus a so-called double pulling function (lock releasing function provided through a double pulling operation of the inside door handle 204) is established.

Further, in the above-mentioned embodiment, the present invention is carried out so as to achieve the canceling function and the one-motion function described above, but can be carried out without those functions. Further, in the above-mentioned embodiment, the present invention is applied to the vehicle door lock device 100 which is installed in the door 201 mounted on the front right side of the vehicle. However, as a matter of course, the present invention is applicable to a vehicle door lock device which is installed in a door mounted on a front left side of the vehicle. Further, in a similar way or through appropriate modifications, the present invention is also applicable to a vehicle door lock device which is installed in a door mounted on a rear right side or a rear left side of the vehicle.

The invention claimed is:

1. A vehicle door lock device, comprising:

a latch mechanism, which is capable of maintaining a door of a vehicle in a closed state with respect to a body, and is adapted to be assembled to the door together with a housing, the latch mechanism comprising a latch engageable with and disengageable from a striker, a pawl engageable with and disengageable from the latch and capable of maintaining and releasing the engagement of the latch with the striker, and a lift lever provided integrally with the pawl;

an open lever, which is rotatably assembled to the housing, and is adapted to be driven along with an operation of a door handle provided on an inner side or an outer side of the door;

an open link, which is interposed between the open lever and the lift lever, and is adapted to be switchable between an unlocked position at which an actuation of the open lever in a door opening direction along with a door opening operation of the door handle is transferred to the lift lever, and a locked position at which the actuation is not transferred to the lift lever; and an electric actuator for switching the open link between the unlocked position and the locked position, wherein the electric actuator comprises:

an active lever, which is rotatably assembled to the housing, and is capable of switching the open link between the unlocked position and the locked position;

a gear unit arranged on an outer side of the active lever;

an electric motor for rotationally driving the gear unit; and a converting mechanism provided between the active lever and the gear unit, for converting motion of the gear unit into motion of the active lever, wherein the gear unit comprises:

a worm, which is rotationally driven by the electric motor; and a worm wheel, which is rotatably assembled to the housing to mesh with the worm, and is linked to the active lever through the intermediation of the converting mechanism, wherein the open link is arranged so as to be pivotable with respect to the housing about a rotation axis whose direction is different from a direction of a rotation axis of the active lever and the worm wheel, wherein the worm wheel is arranged between the latch mechanism and the electric motor, wherein the housing is made of a resin and comprises:

an outer housing body comprising a covering portion covering an outer side of the electric motor and an outer side of the worm, an outer shaft-supporting portion supporting the active lever, and an outer shaft-supporting portion supporting the worm wheel; and an inner housing body comprising an inner shaft-supporting portion supporting the active lever, and an inner shaft-supporting portion supporting the worm wheel, wherein an outer surface of the covering portion of the outer housing body and an outer surface of the outer shaft-supporting portion, which is provided in the outer housing body, for supporting the active lever, are formed in the same flat surface, wherein an outer surface of the outer shaft-supporting portion, which is provided in the outer housing body, for supporting the worm wheel, is formed in a recess or dented region dented inwardly with respect to the flat surface, the recess or dented region dented inwardly with respect to the flat surface functions as a portion for preventing slip of hands of a worker when the vehicle door lock device is assembled to the door of the vehicle by the worker, and the rotation axes of the worm wheel and a lever pass through the recess or dented region, wherein the open lever comprises:

an inside open lever, which is rotatably assembled to the housing, and is adapted to be rotationally driven from an initial position to an actuation position along with a door opening operation of an inside door handle provided on the inner side of the door; and an outside open lever, which is rotatably assembled to the housing, and is adapted to be rotationally driven from an initial position to an actuation position along with a door opening operation of an outside door handle provided on the outer side of the door, wherein the open link is assembled to a coupling portion so as to be capable of tilting by a predetermined degree, comprises a pushing portion engageable with an engagement portion of the lift lever provided to the latch mechanism, and is pushed from an initial position toward the lift lever when the inside open lever is rotationally driven from the initial position to the actuation position or when the outside open lever is rotationally driven from the initial position to the actuation position, the coupling portion being displaced along with rotation of the outside open lever, wherein the active lever is rotatably assembled to the housing, and is switched from an unlocked position to a locked position through a locking operation of a lock/unlock operation member to bring the open link into a locked state, and switched from the locked position to the unlocked position through an unlocking operation of the lock/unlock operation member to bring the open link into an unlocked state, and wherein the vehicle door lock device further comprises:

a spring interposed between the outside open lever and the open link, for biasing the open link so that the open link is brought into the unlocked state, and for retaining the open link movable relative to the lift lever so as to permit the open link to return to the initial position;

an unlocked state maintaining guide for maintaining the open link in the unlocked state when the active lever is at the unlocked position and the outside open lever is rotated between the initial position and the actuation position;

a locked state maintaining guide for maintaining the open link in the locked state when the active lever is at the locked position and the outside open lever is rotated between the initial position and the actuation position; and a push arm portion provided to the active lever, the push arm portion being engaged with the open link in the unlocked state so as to tilt the open link through switching the active lever from the unlocked position to the locked position when the active lever is at the unlocked position, and being disengageable from the open link in the locked state so as to permit the open link to shift to the unlocked state.

2. A vehicle door lock device according to claim 1, wherein the lever is a locking control lever provided within the housing between the latch mechanism and the electric motor so as to extend in an up-and-down direction, the locking control lever having an upper end portion rotatably supported onto the housing and linked to a key cylinder provided on the outer side of the door, and having a lower end portion linked to the active lever, wherein an outer surface of an outer shaft-supporting portion, which is provided in the outer housing body, for supporting the locking control lever, is level and continuous with the recess or dented region.

3. A vehicle door lock device according to claim 1, wherein the recess or dented region is formed into a shape elongated in the up-and-down direction.

4. A vehicle door lock device according to claim 1, wherein the latch mechanism and the electric motor are arranged at the same level with respect to the housing.

5. A vehicle door lock device according to claim 4, wherein the same level means that, under a state in which the vehicle door lock device is assembled to the door, the electric motor is arranged so as to overlap a plane of the latch mechanism projected along a fore-and-aft direction of the door.

6. A vehicle door lock device, comprising:

a latch mechanism, which is capable of maintaining a door of a vehicle in a closed state with respect to a body, and is adapted to be assembled to the door together with a housing;

an open lever, which is rotatably assembled to the housing, and is adapted to be driven along with an operation of a door handle provided on an inner side or an outer side of the door;

an open link, which is interposed between the open lever and a lift lever provided to the latch mechanism, and is adapted to be switchable between an unlocked position at which an actuation of the open lever in a door opening direction along with a door opening operation of the door handle is transferred to the lift lever, and a locked position at which the actuation is not transferred to the lift lever; and an electric actuator for switching the open link between the unlocked position and the locked position, wherein the electric actuator comprises:

an active lever, which is rotatably assembled to the housing, and is capable of switching the open link between the unlocked position and the locked position;

a gear unit arranged on an outer side of the active lever;

an electric motor for rotationally driving the gear unit; and a converting mechanism provided between the active lever and the gear unit, for converting motion of the gear unit into motion of the active lever, wherein the gear unit comprises:

a worm, which is rotationally driven by the electric motor; and a worm wheel, which is rotatably assembled to the housing to mesh with the worm, and is linked to the active lever through the intermediation of the converting mechanism, wherein the open link is arranged so as to be pivotable with respect to the housing about a rotation axis whose direction is different from a direction of a rotation axis of the active lever and the worm wheel, wherein the worm wheel is arranged between the latch mechanism and the electric motor, wherein the housing is made of a resin and comprises:

an outer housing body comprising a covering portion covering an outer side of the electric motor and an outer side of the worm, an outer shaft-supporting portion supporting the active lever, and an outer shaft-supporting portion supporting the worm wheel; and an inner housing body comprising an inner shaft-supporting portion supporting the active lever, and an inner shaft-supporting portion supporting the worm wheel, wherein an outer surface of the covering portion of the outer housing body and an outer surface of the outer shaft-supporting portion, which is provided in the outer housing body, for supporting the active lever, are formed in the same flat surface, wherein the vehicle door lock device further comprises a locking control lever provided within the housing between the latch mechanism and the electric motor so as to extend in an up-and-down direction, the locking control lever having an upper end portion rotatably supported onto the housing and linked to a key cylinder provided on the outer side of the door, and having a lower end portion linked to the active lever, wherein an outer surface of the outer shaft-supporting portion, which is provided in the outer housing body, for supporting the worm wheel, is formed in a recess or dented region dented inwardly with respect to the flat surface, the recess or dented region dented inwardly with respect to the flat surface functions as a portion for preventing slip of hands of a worker when the vehicle door lock device is assembled to the door of the vehicle by the worker, and all points of a straight line passing through the rotation axes of the worm wheel and the locking control lever are in the recess or dented region, wherein the open lever comprises:

an inside open lever, which is rotatably assembled to the housing, and is adapted to be rotationally driven from an initial position to an actuation position along with a door opening operation of an inside door handle provided on the inner side of the door; and an outside open lever, which is rotatably assembled to the housing, and is adapted to be rotationally driven from an initial position to an actuation position along with a door opening operation of an outside door handle provided on the outer side of the door, wherein the open link is assembled to a coupling portion so as to be capable of tilting by a predetermined degree, comprises a pushing portion engageable with an engagement portion of the lift lever provided to the latch mechanism, and is pushed from an initial position toward the lift lever when the inside open lever is rotationally driven from the initial position to the actuation position or when the outside open lever is rotationally driven from the initial position to the actuation position, the coupling portion being displaced along with rotation of the outside open lever, wherein the active lever is rotatably assembled to the housing, and is switched from an unlocked position to a locked position through a locking operation of a lock/unlock operation member to bring the open link into a locked state, and switched from the locked position to the unlocked position through an unlocking operation of the lock/unlock operation member to bring the open link into an unlocked state, and wherein the vehicle door lock device further comprises:

a spring interposed between the outside open lever and the open link, for biasing the open link so that the open link is brought into the unlocked state, and for retaining the open link movable relative to the lift lever so as to permit the open link to return to the initial position;

an unlocked state maintaining guide for maintaining the open link in the unlocked state when the active lever is at the unlocked position and the outside open lever is rotated between the initial position and the actuation position;

a locked state maintaining guide for maintaining the open link in the locked state when the active lever is at the locked position and the outside open lever is rotated between the initial position and the actuation position; and a push arm portion provided to the active lever, the push arm portion being engaged with the open link in the unlocked state so as to tilt the open link through switching the active lever from the unlocked position to the locked position when the active lever is at the unlocked position, and being disenqaqeable from the open link in the locked state so as to permit the open link to shift to the unlocked state.

7. A vehicle door lock device according to claim 6, wherein the recess or dented region is formed into a shape elongated in the up-and-down direction.

8. A vehicle door lock device according to claim 6, wherein the latch mechanism and the electric motor are arranged at the same level with respect to the housing.

9. A vehicle door lock device according to claim 8, wherein the same level means that, under a state in which the vehicle door lock device is assembled to the door, the electric motor is arranged so as to overlap a plane of the latch mechanism projected along a fore-and-aft direction of the door.

10. A vehicle door lock device, comprising:

a latch mechanism, which is capable of maintaining a door of a vehicle in a closed state with respect to a body, and is adapted to be assembled to the door together with a housing;

an open lever, which is rotatably assembled to the housing, and is adapted to be driven along with an operation of a door handle provided on an inner side or an outer side of the door;

an open link, which is interposed between the open lever and a lift lever provided to the latch mechanism, and is adapted to be switchable between an unlocked position at which an actuation of the open lever in a door opening direction along with a door opening operation of the door handle is transferred to the lift lever, and a locked position at which the actuation is not transferred to the lift lever; and an electric actuator for switching the open link between the unlocked position and the locked position, wherein the electric actuator comprises:

an active lever, which is rotatably assembled to the housing, and is capable of switching the open link between the unlocked position and the locked position;

a gear unit arranged on an outer side of the active lever;

an electric motor for rotationally driving the gear unit; and a converting mechanism provided between the active lever and the gear unit, for converting motion of the gear unit into motion of the active lever, wherein the gear unit comprises:

a worm, which is rotationally driven by the electric motor; and a worm wheel, which is rotatably assembled to the housing to mesh with the worm, and is linked to the active lever through the intermediation of the converting mechanism, wherein the open link is arranged so as to be pivotable with respect to the housing about a rotation axis whose direction is different from a direction of a rotation axis of the active lever and the worm wheel, wherein the worm wheel is arranged between the latch mechanism and the electric motor, wherein the housing comprises:

an outer housing body comprising a covering portion covering an outer side of the electric motor and an outer side of the worm, an outer shaft-supporting portion supporting the active lever, and an outer shaft-supporting portion supporting the worm wheel; and an inner housing body comprising an inner shaft-supporting portion supporting the active lever, and an inner shaft-supporting portion supporting the worm wheel, wherein an outer surface of the covering portion of the outer housing body and an outer surface of the outer shaft-supporting portion, which is provided in the outer housing body, for supporting the active lever, are formed in the same flat surface, wherein an outer surface of the outer shaft-supporting portion, which is provided in the outer housing body, for supporting the worm wheel, is formed in a dented surface dented inwardly with respect to the flat surface, wherein the open lever comprises:

an inside open lever, which is rotatably assembled to the housing, and is adapted to be rotationally driven from an initial position to an actuation position along with a door opening operation of an inside door handle provided on the inner side of the door; and an outside open lever, which is rotatably assembled to the housing, and is adapted to be rotationally driven from an initial position to an actuation position along with a door opening operation of an outside door handle provided on the outer side of the door, wherein the open link is assembled to a coupling portion so as to be capable of tilting by a predetermined degree, comprises a pushing portion engageable with an engagement portion of the lift lever provided to the latch mechanism, and is pushed from an initial position toward the lift lever when the inside open lever is rotationally driven from the initial position to the actuation position or when the outside open lever is rotationally driven from the initial position to the actuation position, the coupling portion being displaced along with rotation of the outside open lever, wherein the active lever is rotatably assembled to the housing, and is switched from an unlocked position to a locked position through a locking operation of a lock/unlock operation member to bring the open link into a locked state, and switched from the locked position to the unlocked position through an unlocking operation of the lock/unlock operation member to bring the open link into an unlocked state, and wherein the vehicle door lock device further comprises:

a spring interposed between the outside open lever and the open link, for biasing the open link so that the open link is brought into the unlocked state, and for retaining the open link movable relative to the lift lever so as to permit the open link to return to the initial position;

an unlocked state maintaining guide for maintaining the open link in the unlocked state when the active lever is at the unlocked position and the outside open lever is rotated between the initial position and the actuation position;

a locked state maintaining guide for maintaining the open link in the locked state when the active lever is at the locked position and the outside open lever is rotated between the initial position and the actuation position; and a push arm portion provided to the active lever, the push arm portion being engaged with the open link in the unlocked state so as to tilt the open link through switching the active lever from the unlocked position to the locked position when the active lever is at the unlocked position, and being disengageable from the open link in the locked state so as to permit the open link to shift to the unlocked state.

11. A vehicle door lock device according to claim 10, further comprising a locking control lever provided within the housing between the latch mechanism and the electric motor so as to extend in an up-and-down direction, the locking control lever having an upper end portion rotatably supported onto the housing and linked to a key cylinder provided on the outer side of the door, and having a lower end portion linked to the active lever, wherein an outer surface of an outer shaft-supporting portion, which is provided in the outer housing body, for supporting the locking control lever, is level and continuous with the dented surface.

12. A vehicle door lock device according to claim 10, wherein the dented surface is formed into a shape elongated in the up-and-down direction.

13. A vehicle door lock device according to claim 10, wherein the latch mechanism and the electric motor are arranged at the same level with respect to the housing.

14. A vehicle door lock device according to claim 13, wherein the same level means that, under a state in which the vehicle door lock device is assembled to the door, the electric motor is arranged so as to overlap a plane of the latch mechanism projected along a fore-and-aft direction of the door.

* * * * *